US010139155B2

(12) United States Patent
Lee et al.

(10) Patent No.: US 10,139,155 B2
(45) Date of Patent: Nov. 27, 2018

(54) REFRIGERATOR

(71) Applicant: LG ELECTRONICS INC., Seoul (KR)

(72) Inventors: Wonbok Lee, Seoul (KR); Joonggil Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 136 days.

(21) Appl. No.: 15/397,801

(22) Filed: Jan. 4, 2017

(65) Prior Publication Data

US 2017/0191743 A1 Jul. 6, 2017

(30) Foreign Application Priority Data

Jan. 4, 2016 (KR) ..... 10-2016-0000586

(51) Int. Cl.

| | |
|---|---|
| ***F25D 25/00*** | (2006.01) |
| ***F25D 27/00*** | (2006.01) |
| ***F25D 25/02*** | (2006.01) |
| ***F25D 23/06*** | (2006.01) |
| *F21W 131/305* | (2006.01) |

(52) U.S. Cl.

CPC ..... *F25D 27/00* (2013.01); *F25D 23/067* (2013.01); *F25D 25/02* (2013.01); *F21W 2131/305* (2013.01); *F25D 2400/40* (2013.01)

(58) Field of Classification Search

CPC .. F25D 27/005; F25D 27/00; F21W 2131/305
See application file for complete search history.

(56) References Cited

U.S. PATENT DOCUMENTS

| | | | | |
|---|---|---|---|---|
| 2005/0081547 | A1* | 4/2005 | Avenwedde | F21V 23/06 62/264 |
| 2013/0088136 | A1* | 4/2013 | Bassi | F25D 25/02 312/408 |
| 2014/0217871 | A1* | 8/2014 | Kerner | F25D 25/024 312/236 |
| 2014/0224875 | A1 | 8/2014 | Slesinger et al. | |

FOREIGN PATENT DOCUMENTS

| | | |
|---|---|---|
| KR | 10-2005-0014683 | 2/2005 |
| KR | 10-2006-0105867 | 10/2006 |
| KR | 10-2009-0113768 | 11/2009 |
| KR | 10-2011-0045445 | 5/2011 |

* cited by examiner

*Primary Examiner* — Andrew Coughlin
(74) *Attorney, Agent, or Firm* — Fish & Richardson P.C.

(57) ABSTRACT

A refrigerator includes a shelf holder having holes along a vertical direction on a wall of a food storage chamber, and a shelf assembly attachable to the shelf holder via at least one of the holes. The refrigerator also includes an electronic device provided on the shelf assembly; a holder terminal unit provided between the shelf holder and the wall and having a holder-side terminal facing at least one of the holes; and a shelf terminal unit provided at a side of the shelf assembly that is configured to attach to the shelf holder. The shelf terminal unit has a pin configured to be inserted into and electrically connect with the holder-side terminal in a state in which the shelf assembly is attached to the shelf holder. The pin is electrically connected to the electronic device of the shelf assembly, and is longitudinally movable relative to the shelf terminal unit.

32 Claims, 14 Drawing Sheets

REFRIGERATOR

CROSS-REFERENCE TO RELATED APPLICATIONS

Pursuant to 35 U.S.C. § 119(a), this application claims the benefit of an earlier filing date and right of priority to Korean Patent Application No. 10-2016-0000586, filed on Jan. 4, 2016 in the Korean Intellectual Property Office, the disclosure of which is incorporated herein by reference in its entirety.

TECHNICAL FIELD

The present disclosure relates to a refrigerator having an electronic device on a shelf inside a food storage chamber.

BACKGROUND

A refrigerator is an apparatus for keeping foods and the like in a frozen or fresh state. The refrigerator includes a refrigerator main body having a food storage chamber, and a refrigerating cycle device for cooling an inside of the refrigerator main body. The refrigerating cycle device includes a compressor, a condenser, an expansion device and an evaporator. In general, a machine room is formed at a rear area within the refrigerator main body and the compressor and the condenser of the refrigerating cycle device are installed within the machine room.

The refrigerator is provided with at least one storage unit (e.g., a shelf, a tray, a basket, etc.) for efficiently using a space of the food storage chamber. For example, a shelf and a tray may be disposed in the food storage chamber, and a basket may be disposed on an inner surface of a door coupled to the refrigerator main body. Some refrigerators are also provided with a lighting device for lighting the inside thereof, a display device for outputting information, and the like.

SUMMARY

In one aspect, a refrigerator may include a food storage chamber that includes at least one wall. The refrigerator may also include a shelf holder installed on a wall of the food storage chamber, the shelf holder having a plurality of holes spaced apart from one another along a vertical direction. The refrigerator may also include a shelf assembly attachable to the shelf holder via at least one of the plurality of holes; and an electronic device provided on the shelf assembly. The refrigerator may also include a holder terminal unit provided between the shelf holder and the wall, the holder terminal unit having at least one holder-side terminal disposed to face at least one of the plurality of holes. The refrigerator may also include a shelf terminal unit provided at a side of the shelf assembly that is configured to attach to the shelf holder. The shelf terminal unit may include at least one pin provided on the shelf terminal unit and configured to electrically connect to the at least one holder-side terminal in a state in which the shelf assembly is attached to the shelf holder, the at least one pin being electrically connected to the electronic device provided on the shelf assembly. The shelf terminal unit may also include at least one elastic component coupled to the at least one pin and configured to, in a state in which the shelf assembly is attached to the shelf holder, exert a restoring force on the at least one pin in a direction towards the at least one holder-side terminal of the holder terminal unit.

In some implementations, the shelf assembly may include a shelf portion; and at least one bracket provided beneath the shelf portion and configured to support the shelf portion.

In some implementations, the shelf assembly may be configured to attach to shelf holder by a bracket of the at least one bracket of the shelf assembly attaching to a hole among the plurality of holes of the shelf holder.

In some implementations, the holder terminal unit may be positioned behind the hole of the shelf assembly and may connect to the at least one pin of the shelf terminal unit through the hole.

In some implementations, the shelf holder may be provided on a rear wall of the food storage chamber, the holder terminal unit may be provided at a rear side of the shelf holder, the shelf terminal unit may be provided at a rear side of the shelf assembly, and the elastic component may be configured to exert the restoring force on the at least one pin in a rearward direction.

In some implementations, the electronic device may be attached to the at least one bracket at a position below the shelf portion of the shelf assembly.

In some implementations, the shelf terminal unit may include at least one contact terminal. The contact terminal may be configured to: electrically connect to the electronic device by at least one shelf-side wire, and exert a force on the at least one pin that maintains a contact state with the at least one pin.

In some implementations, each of the at least one contact terminal may include a first portion connected to the at least one shelf-side wire; a second portion extending from the first portion forming a first angle with a longitudinal axis of the pin; and a third portion extending from the second portion and forming a semicircular shape configured to exert the force on the at least one pin on an outer circumferential surface of the at least one pin.

In some implementations, the shelf terminal unit may include a shelf terminal unit housing coupled to a rear side of the shelf assembly and accommodating at least part of the at least one pin. The at least one elastic component may be disposed within the shelf terminal unit housing and may surround the outer circumferential surface of the at least one pin.

In some implementations, the at least one pin may include pin-side ribs protruding from the outer circumferential surface of the at least one pin and configured to prevent a separation of the at least one pin from the shelf terminal unit housing, each of the pin-side ribs formed at a location facing a first end of the at least one elastic component. The shelf terminal unit housing may include housing-side ribs protruding from inside of the shelf terminal unit housing and configured to limit a movement of the at least one elastic component, each of the housing-side ribs formed at a location facing a second end of the at least one elastic component that is opposite to the first end. The at least one elastic component may be compressed by the pin-side ribs and the housing-side ribs, and supply the restoring force to the pin-side ribs and the housing-side ribs.

In some implementations, the at least one pin may include a first pin and a second pin that are spaced apart from each other. The shelf terminal unit housing may include a plurality of protruding portions formed between the first pin and the second pin. The plurality of protruding portions may be spaced apart from one another by interposing drain channels therebetween.

In some implementations, the shelf terminal unit housing may be provided with at least one drain hole that forms an opening between an inside of the shelf terminal unit and an outside of the shelf terminal unit.

In some implementations, the shelf terminal unit housing may include at least one elastic component receiving groove in which the at least one elastic component is received. A radius of curvature of each of the at least one elastic component receiving groove may be greater than a radius of curvature of each of the at least one elastic component.

In some implementations, the shelf terminal unit housing may include at least one pin hole that is formed in a direction toward the shelf holder in a state in which the shelf assembly is attached to the shelf holder. The at least one pin may be linearly movable relative to the shelf terminal unit housing through the at least one pin hole.

In some implementations, the holder terminal unit may include an opening that is opened toward the food storage chamber, and a holder terminal unit body that is installed on a rear side of the shelf holder in a direction that faces the holes. The at least one holder-side terminal may be fixed to the holder terminal unit body.

In some implementations, the holder terminal unit may include at least one holder-side wire disposed on a rear side of the holder terminal unit body. At least some parts of the at least one holder-side terminal may be exposed to an inside of the holder terminal unit body and other parts of the at least one holder-side terminal may be connected to the at least one holder-side wire through the holder terminal unit body.

In some implementations, each of the at least one holder-side terminal may include a stopping portion that is bent from an outside of the holder terminal unit body and locked on a rear surface of the holder terminal unit body.

In some implementations, each of the at least one holder-side terminal may include a recess portion having a periphery that is smaller than a periphery of a coating member of each holder-side wire. The recess portion may be insertable into the coating member of the holder-side wire such that the periphery of the recess portion is contactable with a conductive member within the coating member.

In some implementations, the holder terminal unit body may be provided with at least one drain hole that provides an opening between an inside of the holder terminal unit and an outside of the holder terminal unit.

In some implementations, the at least one drain hole may be provided at a location on the holder terminal unit that is vertically below a location of the at least one holder-side terminal.

In some implementations, each of the at least one holder-side terminal may be spaced apart from a bottom surface of the holder terminal unit body.

In some implementations, the refrigerator may further include a cover disposed between the shelf holder and the holder terminal unit body. The cover may include a cut portion through which the shelf terminal unit is inserted.

In some implementations, the cover may be provided with a door in a cantilevered shape that is configured to be pushed by the shelf terminal unit.

In some implementations, the electronic device may include a lighting device.

In some implementations, the lighting device may be configured to emit light by receiving power in a state in which the at least one shelf-side terminal and the at least one holder-side terminal are brought into contact with each other and electrically connected. The shelf assembly may further include a wire cover extending from a rear side to a front side of one of the at least one bracket along the at least one bracket, the wire cover being coupled to an inner side surface of the one of the at least one bracket and covers at least one shelf-side wire connecting the lighting device to the at least one shelf-side terminal.

In some implementations, the at least one bracket may include a left bracket supporting a left side of the shelf portion, and a right bracket supporting a right side of the shelf portion. The shelf assembly may include a lighting device cover formed to accommodate the lighting device and having both ends open, at least part of the lighting device composed of a transparent material; and a cap that is partially inserted into a first end of the lighting device cover and mounted on one of the left bracket and one end of the right bracket. The wire cover may be inserted into a second end of the lighting device cover and mounted on another of the left bracket and the right bracket.

In some implementations, the at least one shelf-side wire may be inserted into the lighting device cover through the wire cover, and may be connected to the lighting device disposed within the lighting device cover.

In some implementations, the lighting device may be configured to illuminate an area below or to the rear of the lighting device.

In some implementations, the shelf holder may further include a plurality of covers, each cover configured to cover one hole of the plurality of holes in a state in which the at least one bracket of the shelf assembly is not attached to the one hole of the plurality of holes.

In some implementations, the shelf portion may be configured to slide in a forward direction relative to the at least one bracket.

In some implementations, the shelf portion may be configured to slide in the forward direction such that a front of the shelf portion is positioned further forward than the electronic device.

In another aspect, a refrigerator includes a food storage chamber that includes at least one wall; and a shelf holder having a plurality of holes spaced apart from one another along a vertical direction and installed on a wall of the food storage chamber. The refrigerator may also include a shelf assembly attachable to the shelf holder via at least one of the plurality of holes; and an electronic device provided on the shelf assembly. The refrigerator may further include a holder terminal unit provided between the shelf holder and the wall, the holder terminal unit having at least one holder-side terminal disposed to face at least one of the plurality of holes. The refrigerator may further include a shelf terminal unit provided at a side of the shelf assembly that is configured to attach to the shelf holder, the shelf terminal unit having at least one pin configured to electrically connect to the at least one holder-side terminal in a state in which the shelf assembly is attached to the shelf holder, the at least one pin being electrically connected to the electronic device provided on the shelf assembly. The at least one pin may be longitudinally movable relative to the shelf terminal unit.

Further scope of applicability of the present application will become more apparent from the detailed description given hereinafter. However, it should be understood that the detailed description and specific examples, while describing some implementations, are given by way of illustration only, since various changes and modifications within the spirit and scope of the invention will become apparent to those skilled in the art from the detailed description.

DETAILED DESCRIPTION

Figure 1:
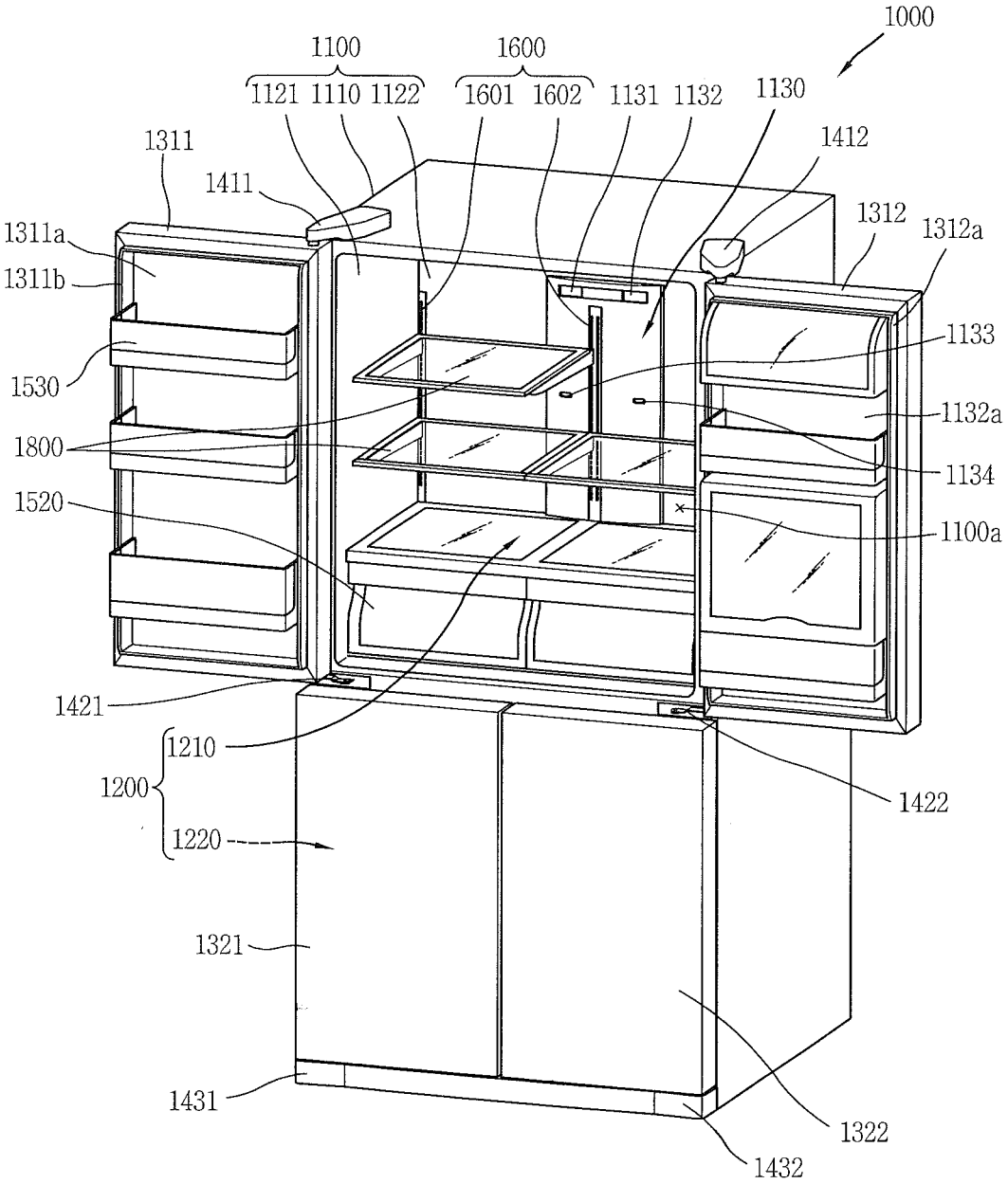
FIG. 1 is a diagram of illustrating an example of a refrigerator in accordance with some implementations.

Systems and techniques are disclosed that enable a refrigerator with an electronic device provided on a shelf of the refrigerator. The electronic device is powered via an electrical connection established between the shelf and a shelf holder on a wall of the refrigerator. The refrigerator is provided with a power supply structure that supplies power to the electronic device via the electrical connection.

The electronic device that is provided on the shelf of the refrigerator may provide user convenience and visual attraction. As an example, the electronic device may be a lighting device that illuminates the contents of an individual shelf insides the refrigerator. In some implementations, the shelf may be configured to be attached and detached by a user, for example, to change a height of the shelf. When a lighting device is installed on a mount-type shelf which is inserted into the food storage chamber and mounted to a shelf holder, there may be challenges in supplying power to the lighting device by a general power supply structure using a cable.

For example, if the lighting device is installed on a shelf that can be arbitrarily attached or detached by a user or an operator, there may be a risk of a disconnection, a defective contact, or damage to the power supply structure caused by physical impact during the attachment or detachment of the shelf.

As another example, a shelf which is installed in the food storage chamber may be exposed to moisture and the like, causing a fatal risk to the power supply structure. If the power supply structure that supplies power to the lighting device of the shelf is exposed to moisture and the like, the power supply may be likely to fail.

In addition, when the power supply structure that supplies power to the lighting device of the shelf is out of order or defective, there may be challenges to detaching the shelf, the power supply structure connected to the refrigerator main body, and related components which protect the power supply structure and the shelf or are connected to them.

Implementations described herein provide a refrigerator having a structure that facilitates access to an repair of such related components, even without necessarily disassembling all of the components, when a breakdown or defect is caused in a structure of supplying power to a lighting device of a shelf assembly.

In some implementations, a refrigerator includes a shelf terminal unit, a holder terminal unit, and a shelf assembly configured to mitigate problems such as a disconnection, a defective contact, or damage of the shelf assembly during repetitive attachment or detachment of the shelf assembly, and that stably maintain an electrically-connected state of the shelf assembly.

The shelf terminal unit and a holder terminal unit may be configured to be protected from moisture, which may mitigate risk to electrical components inside the shelf terminal unit and the holder terminal unit. In some implementations, the shelf terminal unit and the holder terminal unit may be configured to drain water that collects inside the shelf terminal unit and the holder terminal unit.

According to some implementations, an electric contact structure between the shelf terminal unit and the holder terminal unit with high reliability can be implemented by pins that are elastically linearly movable inside and outside of the shelf terminal unit and the holder-side terminals that are fixed to the holder terminal unit. The elastic contact structure can reduce impact which is generated when attaching the shelf assembly to the shelf holder. The connection between the pins and the holder-side terminals may be maintained by a structure within the shelf terminal unit that exerts a force on the pins toward the holder-side terminals, maintaining a stable contact state between the pins and the holder-side terminals.

As such, the movable pins within the shelf side terminal unit provide a stable connection with the holder side terminals. Accordingly, when the pins are defective, the shelf terminal unit may be easily removed by simply detaching the shelf assembly from the shelf holder, without necessarily disassembling the holder terminal unit that is provided in the shelf holder.

In some implementations, the contact terminals of the shelf terminal unit may be configured to press the outer circumferential surfaces of the pins at both sides of the pins, and thus the electric contact between the pins and the contact terminals can be maintained despite the pins moving inside and outside of the shelf terminal unit.

For example, the first portion of each contact terminal is connected to the shelf-side wire and the third portion is brought into contact with the outer circumferential surface of the pin, and the second portion connects the first portion and the third portion to each other. Accordingly, the contact terminal can implement the electric connection between the shelf-side wire and the pin. In particular, the second portion may extend in a tilted direction, which may result in optimizing a pressed amount of the pin and thus maintaining the electric contact state with high reliability.

In some implementations, drain channels and drain holes may be formed at the housing of the shelf terminal unit, such that water collected in the housing can be discharged to outside. This may result in preventing the electric connection of the shelf terminal unit from being affected due to the water.

Elastic member receiving grooves formed on the housing of the shelf terminal unit may form spaces in a shape of a semicircular pillar, and a radius of curvature of each of them may be greater than that of each elastic member. Therefore, frictional force generated between the inner side surface of the housing of the shelf terminal unit and the elastic member can be reduced, and also degradation of intensity which is likely to be caused as the housing and the elastic member are excessively spaced apart from each other can be prevented.

The pins may be exposed to outside of the shelf terminal unit through pin holes of the first housing, and thus a separation of the pins to the outside of the housing can be prevented although the first housing and the second housing are spaced more apart from each other.

The holder-side terminals may be fixed to the body of the holder terminal unit. This may prevent a breakdown of the holder-side terminals even though the shelf assembly is repetitively attached to and detached from the shelf holder.

A stopping portion of each of the holder-side terminals may be locked on a rear surface of the body, which may result in preventing the holder-side terminal from being separated from the inside of the body of the holder terminal unit. Also, the recess portion of each of the holder-side terminals may have a smaller periphery than the coating member of the holder-side wire. Accordingly, the holder-side wire can be inserted into the coating member of the holder and thus the periphery of the holder-side wire can be brought into contact with the conductive member within the coating member, thereby implementing the electric connection between the holder-side terminal and the holder-side wire.

Drain holes may also be formed at the body of the holder terminal unit, and the holder-side terminals may be provided at a height above the drain holes, which may be provided near the bottom surface of the body of the holder terminal unit. As such, water collected in the body of the holder terminal unit can be discharged to the outside and the holder-side terminals can be prevented from being affected by the water.

A cover may be provided between the shelf holder and the body of the holder terminal unit, which may help mitigate introduction of moisture into the body of the holder terminal unit. The cover may be provided with a cut portion, through which the shelf terminal unit can be inserted into the body of the holder terminal unit. Also, the cover may have a door in a cantilevered shape, and the door can be pushed to one side when the shelf terminal unit is inserted into the body of the holder terminal unit. This may prevent the shelf terminal unit from being stuck in the cover.

The shelf assembly may include a wire cover coupled to an inner side surface of one bracket, so as to protect the shelf-side wires, which electrically connect the lighting device of the shelf and the shelf terminal unit, from external impact or moisture.

In some implementations, a cap may be inserted into one end of the lighting device cover and the wire cover may be inserted into another end of the lighting device cover, thereby preventing introduction of moisture into the lighting device cover. The cap and the wire cover may be supported by the bracket, and thus the lighting device cover can be indirectly supported on the bracket by virtue of the cap and the wire cover. Also, the shelf-side wires may be inserted into the lighting device cover through the wire cover, so as to be electrically connected to the lighting device as well as being protected by the wire cover.

FIG. 1 is a diagram illustrating an example of a refrigerator 1000 in accordance with some implementations.

Appearance of the refrigerator 1000 is defined by a refrigerator main body 1100 and doors 1311, 1312, 1321 and 1322. The refrigerator main body 1100 includes an outer case 1110 and an inner case 1121, 1122.

The outer case 1110 defines the rest of appearance of the refrigerator 1000 except for a front portion of the refrigerator 1000 which is defined by the doors 1311, 1312, 1321 and 1322. An upper surface or side surfaces of the refrigerator 1000 illustrated in FIG. 1 all correspond to the outer case 1110.

The inner case 1121, 1122 is installed within the outer case 1110. The inner case 1121, 1122 forms a food storage chamber 1200 located within the refrigerator main body 1100. The food storage chamber 1200 may be divided into a refrigerating chamber 1210 and a freezing chamber 1220 according to a set temperature.

FIG. 1 illustrates a bottom freezer type refrigerator with the refrigerating chamber 1210 in an upper portion of the refrigerator main body 1100 and the freezing chamber 1220 in a lower portion of the refrigerator main body 1100. However, implementations are not necessarily limited to the bottom freezer type refrigerator 1000 and may alternatively be applied to a side-by-side type refrigerator with a refrigerating chamber and a freezing chamber disposed in left and right sides, a top mount type refrigerator with a freezing chamber disposed above a refrigerating chamber, and the like.

The inner case 1121, 1122 forms inner side walls of the food storage chamber 1200. The inner case 1121, 1122 may be divided according to a position. For example, FIG. 1 illustrates side walls 1121 and a rear wall 1122.

In some implementations, an insulating member is interposed between the outer case 1110 and the inner case 1121, 1122.

The rear wall 1122 is coupled with a duct structure 1130 through which cold air is supplied into the food storage chamber 1200. A back of the food storage chamber 1200 is visually obscured by the rear wall 1122 and the duct structure 1130. The duct structure 1130 also forms a wall of the food storage chamber 1200 and is located in the rear portion of the food storage chamber 1200. Thus, the rear wall 1122 may include the duct structure 1130 as well as the inner case 1121, 1122.

In some implementations, a fan for supplying cold air into the food storage chamber 1200 is installed at an area which is visually obscured by the duct structure 1130. The duct structure 1130 forms a cold air passage through which cold air supplied by the fan flows into the food storage chamber 1120. The duct structure 1130 also includes cold air discharge ports 1131, 1132, 1133 and 1134, which are open toward the food storage chamber 1200. Cold air generated by the fan flows along the cold air passage of the duct structure 1130 and is supplied into the food storage chamber 1130 through the cold air discharge ports 1131, 1132, 1133 and 1134.

The doors 1131, 1312, 1321 and 1322 are coupled to the refrigerator main body 1100 and form the appearance of the front portion of the entire appearance of the refrigerator 1000. The doors 1131, 1312, 1321 and 1322 open and close a front opening 1100*a* of the refrigerator main body 1100. The front opening 1100*a* of the refrigerator main body 1100 is an area through which foods are put in the food storage chamber 1200 and taken out of the food storage chamber

1200. The doors 1131, 1312, 1321 and 1322 may be classified into rotating doors or drawer-type doors according to an opening/closing method. The rotating door is rotatably installed on the refrigerator main body 1100 and the drawer-type door is slidably connected to the refrigerator main body 1100.

The doors 1131, 1312, 1321 and 1322 may be classified according to installation positions. Doors for opening and closing the refrigerating chamber 1210 are classified as refrigerating chamber doors 1321 and 1322, and doors for opening and closing the freezing chamber 1220 may be classified into freezing chamber doors 1321 and 1322. Also, the doors 1131, 1312, 1321 and 1322 may be classified into a left refrigerating chamber door 1311, a right refrigerating chamber door 1312, a left freezing chamber door 1321 or a right freezing chamber door 1322 according to whether the installation position is left or right.

The doors 1131, 1312, 1321 and 1322 are provided therein with door liners 1311*a*, 1312*a*, and door liners may also be provided for the freezing chamber doors. Gaskets 1311*b*, 1312*b* for preventing a leakage of cold air are installed on peripheries of the door liners 1311*a*, 1312*a*, and gaskets may also be provided for the freezing chamber doors. The door liners 1311*a*, 1312*a* define food storage spaces along with baskets 1530 to be explained later. The gaskets 1311*b*, 1312*b* are closely adhered on edges of the front opening 1100*a* so as to hermetically seal the food storage chamber 1200.

FIG. 1 illustrates the rotating doors 1131, 1312, 1321 and 1322 which are rotatably coupled to the refrigerator main body 1100. The refrigerator 1000 includes hinges 1411, 1412, 1421, 1422, 1431 and 1432 for implementing the rotation of the rotating doors 1131, 1312, 1321 and 1322.

The hinges 1411, 1412, 1421, 1422, 1431 and 1432 are divided into upper hinges 1411 and 1412, middle hinges 1421 and 1422, or lower hinges 1431 and 1432. The upper hinges 1411 and 1412 are disposed on an upper surface of the refrigerator main body 1100 on the basis of FIG.1. The middle hinges 1421 and 1422 are disposed between the refrigerating chamber doors 1311 and 1312 and the freezing chamber doors 1321 and 1322. The lower hinges 1431 and 1432 are disposed beneath the freezing chamber doors 1321 and 1322.

The upper hinges 1411 and 1412 and the middle hinges 1421 and 1422 are connected to tops and bottoms of the refrigerating chamber doors 1311 and 1412, respectively, to implement the rotation of the refrigerating chamber doors 1311 and 1312. The middle hinges 1421 and 1422 and the lower hinges 1431 and 1432 are connected to tops and bottoms of the freezing chamber doors 1321 and 1322, respectively, to implement the rotation of the freezing chamber doors 1321 and 1322.

The refrigerator 1000 includes at least one storage unit 1520, 1530, 1800 for efficiently using the space of the food storage chamber 1200. The storage unit 1520, 1530, and 1800 may include a shelf assembly 1800, a tray assembly 1520 and a basket 1530. The shelf assembly 1800 and the tray assembly 1520 may be installed in the food storage chamber 1200, and the basket 1530 may be installed on an inner surface of the doors 1311, 1312, 1321 and 1322.

Figure 9:
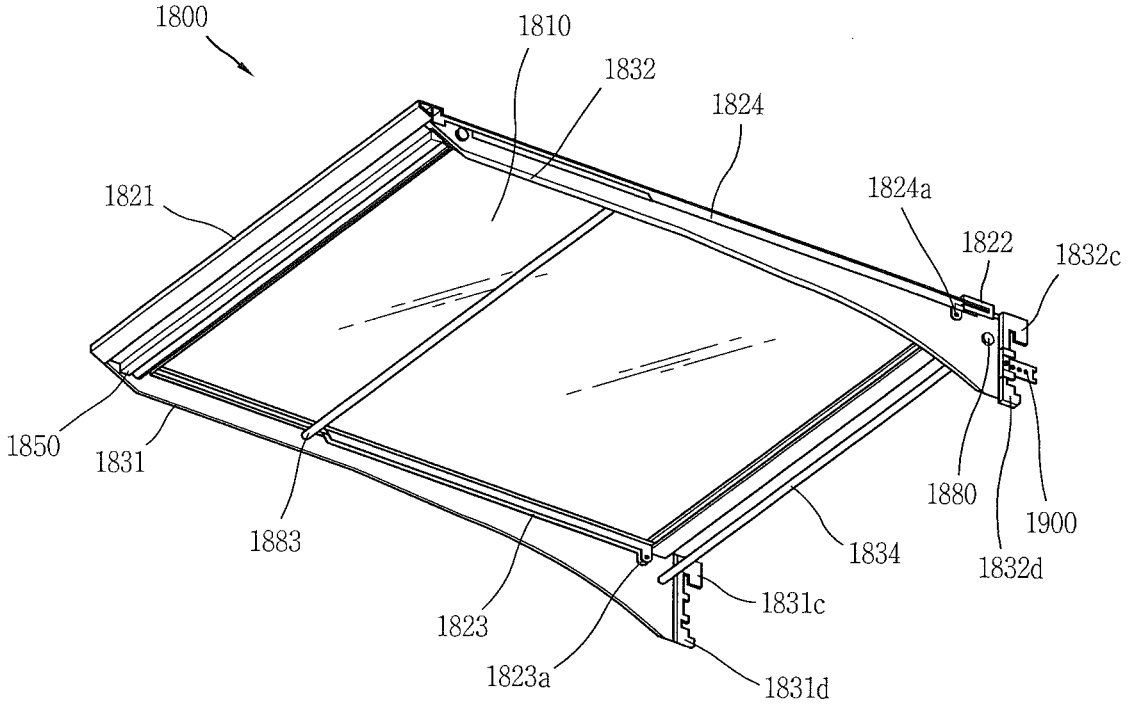
FIG. 9 is a diagram illustrating an example of a perspective view of a shelf s assembly and a shelf terminal unit.

The shelf assembly 1800 includes a plate-shaped shelf 1810 (see FIG. 9). The shelf 1810 is installed horizontally in the food storage chamber 1200 such that foods are put on an upper surface thereof. The shelf assembly 1800 may be mounted (attached) to a shelf holding assembly 1600 which is installed on the rear wall 1122. The shelf holding assembly 1600 includes at least one shelf holder 1601, 1602. The shelf assembly 1800 may include the shelf 1810 for keeping things thereon, and components which are required to attach the shelf 1810 to the shelf holding assembly 1600. The shelf assembly 1800 will be described in more detail later.

In some implementations, guide portions may be provided on both side walls 1121 of the inner case 1121, 1122. The shelf assembly 1800 may be supported by the guide portions.

The shelf assembly 1800 may have a width corresponding to a distance between the both side walls 1121 of the inner case 1121, 1122. Accordingly, during a process of inserting the shelf assembly 1800 toward the rear wall 1122 of the inner case 1121, 1122, the insertion (or movement) of the shelf assembly 1800 toward the rear wall 1122 can be guided by the both side walls 1121 and a movement thereof in left and right directions can be limited.

The shelf holding assembly 1600 is installed on the rear wall 1122 of the food storage chamber 1200. As aforementioned, the rear wall 1122 of the food storage chamber 1200 may include the duct structure 1130 in addition to the rear wall 1122 formed by the inner case 1121, 1122, and thus the shelf holding assembly 1600 may be installed on the rear wall 1122 of the inner case 1121, 1122 and the duct structure 1130. FIG. 1 illustrates both of a shelf holder 1601 installed on the rear wall 1122 formed by the inner case 1121, 1122, and a shelf holder 1602 installed on the duct structure 1130.

The shelf holding assembly 1600 supports the shelf assembly 1800. The shelf assembly 1800 is attached to the shelf holding assembly 1600. Referring to FIG. 1, the shelf holding assembly 1600 may extend in an up and down direction. Therefore, the plural shelf assemblies 1800 can be attached to the shelf holding assembly 1600 in the up and down direction. The shelf assembly 1800 may be arbitrarily attached to or detached from the shelf holding assembly 1600 by a user or operator. Description of the shelf holding assembly 1600 can be applied to the shelf holder 1601, 1602.

The tray assembly 1520 forms a space which is separate from the other space of the food storage chamber 1200 and keeps foods therein. The tray assembly 1520 may be supported on a bottom surface of the inner case 1121, 1122. The tray assembly 1520 may be slidable by virtue of the bottom surface of the inner case 1121, 1122 or a slide module. The tray assembly 1520 may include a tray for separating the space of the food storage chamber 1200, and components required for slidably moving the tray.

The basket 1530 forms a shielding layer for preventing foods from being dropped from the door. The door liners 1311*a*, 1312*a* are disposed on the inner surface of the doors 1311, 1312, 1321 and 1322, and the baskets 1530 are coupled to the door liners 1311*a*, 1312*a*. The door liners 1311*a*, 1312*a* form a bottom surface and inner side walls for storing foods, and the basket 1530 forms outer side walls.

The shelf assembly 1800 may be provided with an electronic device, if needed. The electronic device, for example, includes a lighting device 1840 (see FIG. 10) for lighting up the food storage chamber 1200. The lighting device 1840 may include every component, such as a fluorescent light, an incandescent light, a light-emitting device (LED), or the like, which emits light.

In order for the lighting device 1840 to light up the food storage chamber 1200, power should be supplied to the lighting device 1840. In some implementations, a power supply unit may be provided in the refrigerator 1000 and supply power to the lighting device 1840 via an electrical connection. Hereinafter, the electric connection structure between the refrigerator main body 1100 and the lighting device 1840 will be described, taking into account of characteristics of inner environments of the refrigerator 1000.

Figure 2:
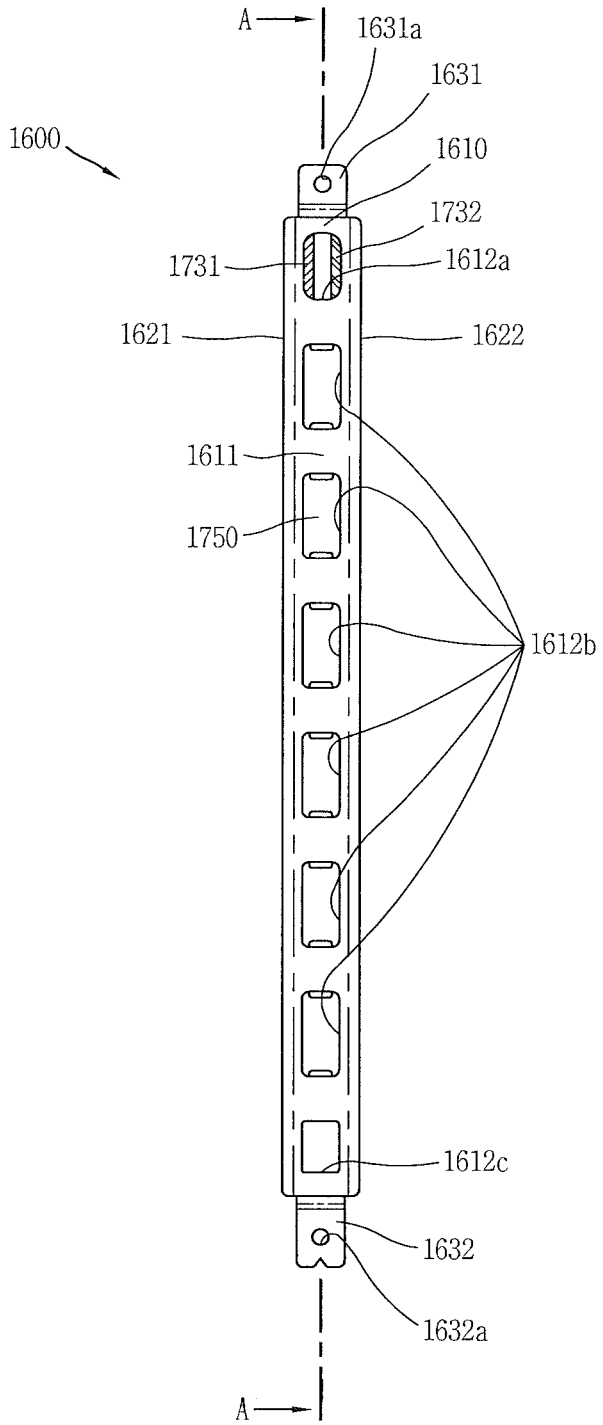
FIG. 2 is diagram illustrating an example of a front view of a shelf holder illustrated in FIG. 1.

FIG. 2 is a diagram illustrating an example of a front view of the shelf holding assembly 1600 illustrated in FIG. 1.

The shelf holding assembly 1600*h* extends in an up and down direction. When a user views the shelf holding assembly 1600 installed in the food storage chamber 1200 at the front of the shelf holding assembly 1600, the shelf holding assembly 1600 includes a front portion 1610 and side portions 1621 and 1622. The front portion 1610 of the shelf holding assembly 1600 is illustrated in FIG. 2, and the structure of the side portions 1621 and 1622 of the shelf holding assembly 1600 will be understood with reference to FIG. 3.

A plurality of holes 1612*a*, 1612*b* and 1612*c* are formed through the front portion 1600 in an up and down direction. The holes 1612*a*, 1612*b* and 1612*c* are spaced apart from one another. A shelf supporting portion 1611 for supporting the shelf assembly 1800 (see FIG. 1) is formed between two neighboring holes (two of the holes 1612*a*, 1612*b* and 1612*c*). The shelf supporting portions 1611 form the front portion 1610 of the shelf holding assembly 1600 except for the holes 1612*a*, 1612*b* and 1612*c*, and each of the shelf supporting portions 1611 forms a boundary between the two neighboring holes of the holes 1612*a*, 1612*b* and 1612*c*.

The holes 1612*a*, 1612*b* and 1612*c* and the shelf supporting portions 1611 are components for mounting the shelf assembly 1800 (see FIG. 1). The attachment of the shelf assembly 1800 may be implemented in a manner that hook portions 1831*c* and 1832*c* (see FIG. 9) of the shelf assembly 1800 are inserted into the holes 1612*a*, 1612*b* and 1612*c* to be mounted on the shelf supporting portions 1611.

The reason of providing the plurality of holes 1612*a*, 1612*b* and 1612*c* is to randomly change a location (height) of the shelf assembly 1800. Also, some (1612*b*) of the holes 1612*a*, 1612*b* and 1612*c* may have the same size to allow for randomly changing the location (height) of the shelf assembly 1800. With the formation of the holes 1612*b* in the same size, the user can adjust the height of the shelf assembly 1800 by changing the mounting location of the shelf assembly 1800.

However, referring to FIG. 2, the top hole 1612*a* and the bottom hole 1612*c* of the holes 1612*a*, 1612*b* and 1612*c* of the shelf holding assembly 1600 may have different sizes from the other hole 1612*b*. When one assembly 1800 is mounted to the shelf holding assembly 1600, at least two holes 1612*a*, 1612*b*, 1612*c* are required.

If it is assumed that two portions where the shelf holder 1800 is attached to the shelf holding assembly 1600 is an upper portion (corresponding to the hook portion 1831*c*, 1832*c* to be explained later) and a lower portion (corresponding to an inserting portion 1831*d*, 1832*d* to be explained later), the upper portion is inserted into an upper hole of two arbitrary holes and the lower portion is inserted into a lower hole of the two arbitrary holes. In this instance, only the upper portion of the shelf assembly 1800 (see FIG. 1), other than the lower portion of the shelf assembly 1800, is always inserted into the top hole 1621*a*. Therefore, the top hole 1612*a* may be formed as great as the upper portion of the shelf assembly 1800 being insertable and does not have to be formed in the same size as the other holes 1612*b*. For such reason, the bottom hole 1612*c* does not have to be formed in the same size as the other holes 1612*b* as well.

On the other hand, into the other holes 1612*b* may be inserted the upper portion or lower portion of the shelf assembly 1800 according to the location of the shelf assembly 1800. Therefore, the other holes 1612*b* are all preferably formed in the same size.

The shelf holding assembly 1600 is provided with rear wall coupling portions 1631 and 1632 at upper and lower ends thereof, respectively. The rear wall coupling portions 1631 and 1632 are provided to couple the shelf holding assembly 1600 to the rear wall 1122 (see FIG. 1) or the duct structure 1130 (see FIG. 1).

The rear wall coupling portions 1631 and 1632 are provided with rear wall coupling holes 1631*a* and 1632*a*, respectively. The rear wall coupling holes 1631*a* and 1632*a* are open toward the rear wall 1122 or the duct structure 1130 of the food storage chamber 1200. When coupling members, such as bolts, are inserted into the rear wall coupling holes 1631*a* and 1632*a* and the coupling members are inserted into the rear wall 1122 or the duct structure 1130 of the food storage chamber 1200, the shelf holding assembly 1600 may be fixed to the rear wall 1122 or the duct structure 1130.

A holder terminal unit 1700 is installed on a rear side of the shelf holding assembly 1600. FIG. 2 illustrates a cover 1750 and two holder-side wires 1731 and 1732 of the holder terminal unit 1700 visually exposed through the hole 1612*a*. The cover 1750 obscures the holes 1612*b* of the shelf holding assembly 1600 at the rear of the shelf holding assembly 1600. The holes 1612*b* are obscured in order to prevent an introduction of moisture from the food storage chamber 1200 and a visual exposure of the holder terminal unit 1700.

A sectional structure taken along the line A-A will be described later with reference to FIG. 6.

Figure 3:
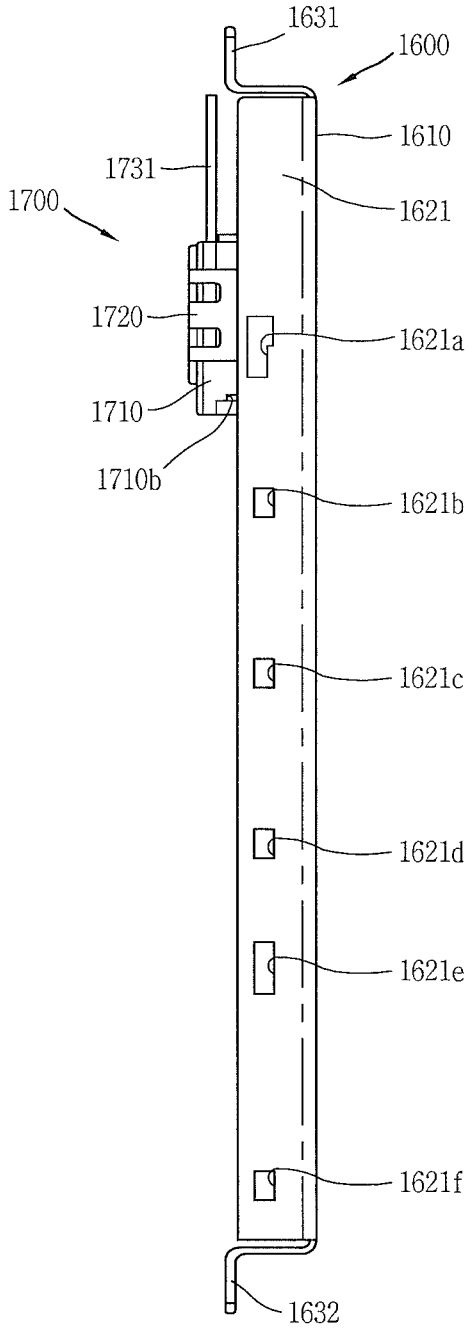
FIG. 3 is a diagram illustrating an example of a side view of the shelf holder illustrated in FIG. 1 and a holder terminal unit installed on the shelf holder.

FIG. 3 is a diagram illustrating an example of a side view of the shelf holding assembly 1600 illustrated in FIG. 1 and the holder terminal unit 1700 installed on the shelf holding assembly 1600. FIG. 3 is a view of the shelf holding assembly 1600 and the holder terminal unit 1700, viewed from a left side thereof. As the shelf holding assembly 1600 is viewed from the left side, the holder terminal unit 1700 coupled to the shelf holding assembly 1600 can also be viewed.

A left portion 1621 of the shelf holding assembly 1600 is bent from the front portion 1610 of the shelf holding assembly 1600 and extends toward the rear wall 1122 of the food storage chamber 1200. The left portion 1621 of the shelf holding assembly 1600 extends in the up and down direction, similar to the front portion to 1610 of the shelf holding assembly 1600. In some implementations, a right portion 1622 (see FIG. 6) of the shelf holding assembly 1600 also has a structure which is substantially similar to the left portion 1621 of the shelf holding assembly 1600.

Terminal portion coupling holes 1621*a*, 1621*b*, 1621*c*, 1621*d*, 1621*e* and 1621*f* are formed through the left portion 1621 of the shelf holding assembly 1600. The terminal portion coupling holes 1621*a*, 1621*b*, 1621*c*, 1621*d*, 1621*e* and 1621*f* are arranged, with being spaced apart from each other, in the up and down direction that the left portion 1621 of the shelf holding assembly 1600 extends.

The terminal portion coupling holes 1621*a*, 1621*b*, 1621*c*, 1621*d*, 1621*e* and 1621*f* may not always have to be in the same size. However, the terminal portion coupling holes 1621*a*, 1621*b*, 1621*c*, 1621*d*, 1621*e* and 1621*f* should have sizes which are great enough to accommodate shelf hold coupling protrusions 1711*a* and 1712*a* (see FIGS. 4 to 7) of the holder terminal unit 1700 which will be explained later. For example, when the shelf holder coupling protrusions 1711*a* and 1712*a* have the same size as that of the lowermost (bottom) terminal portion coupling hole 1621*f*, the other terminal portion coupling holes 1621*a*, 1621*b*, 1621*c*, 1621*d*, and 1621*e* should have sizes which are the same as or greater than the size of the lowermost terminal portion coupling hole 1621*f*.

The terminal portion coupling holes 1621*a*, 1621*b*, 1621*c*, 1621*d*, 1621*e* and 1621*f* are provided for coupling between the shelf holding assembly 1600 and the holder terminal unit 1700. A location (height) of the holder terminal unit 1700 is decided based on to which of the terminal portion coupling holes 1621*a*, 1621*b*, 1621*c*, 1621*d*, 1621*e* and 1621*f* the holder terminal unit 1700 is coupled.

The terminal portion coupling holes 1621*a*, 1621*b*, 1621*c*, 1621*d* 1621*e* and 1621*f* are spaced apart from one another in the up and down direction, but formed at the same position in a left and right direction. Accordingly, the position of the holder terminal unit 1700 can also arbitrarily change, similar to the arbitrary change of the position of the shelf assembly 1800.

The rear wall coupling portions 1631 and 1632 is primarily bent from the front portion 1610 of the shelf holding assembly 1600 toward the rear wall 1122 or the duct structure 1130 of the food storage chamber 1200, and then secondarily bent in a parallel direction to the front portion 1610. The rear wall coupling portions 1631 and 1632 are closely adhered on the rear wall 1122 or the duct structure 1130.

The holder supporting unit 1700 is installed on the rear of the shelf holding assembly 1600. The holder terminal unit 1700 is partially surrounded by the front portion 1610, the left portion 1621 and the right portion 1622 of the shelf holding assembly 1600. When viewing a side surface of the holder terminal unit 1700 coupled to the shelf holding assembly 1600, as illustrated in FIG. 3, a body 1710 and a body cover 1720 covering the body 1710 are partially viewed.

The body 1710 is provided with a drain hole 1710*b* in case where moisture is filled in the body 1710 or water is condensed in the body 1710. The drain hole 1710*b* is located at a lower portion of the body 1710, and allows inside and outside of the body 1710 to communicate with each other.

The holder terminal unit 1700 includes holder-side wires 1731 and 1732 (see FIGS. 2 and 4 to 8). The holder-side wires 1731 and 1732 are disposed between the body 1710 and the body cover 1720. The holder-side wires 1731 and 1732 are electrically connected to the holder terminal unit 1700 and a power supply unit of the refrigerator main body 1100.

A more detailed structure of the holder terminal unit 1700 will be described with reference to FIGS. 4 to 8.

Figure 4:
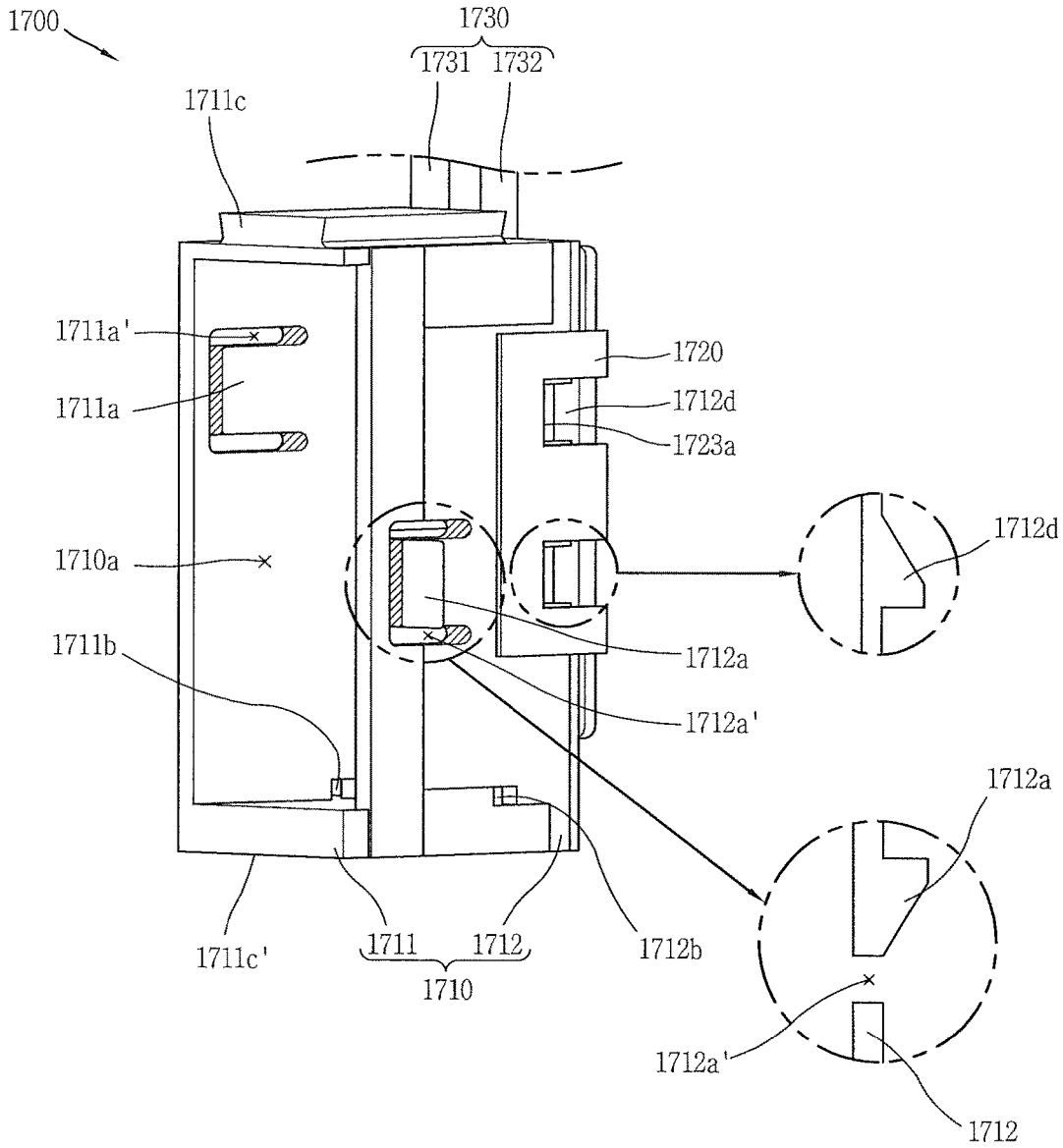
FIG. 4 is a diagram illustrating an example of a perspective view of the holder terminal unit illustrated in FIG. 3.

FIG. 4 is a diagram illustrating an example of a perspective view of the holder terminal unit 1700 illustrated in FIG. 3.

The holder terminal unit 1700 includes the body 1710, the body cover 1720 and the holder-side wires 1731 and 1732. Appearance of the holder terminal unit 1700 is defined by the body 1710 and the body cover 1720.

The body 1710 has a size insertable into the rear of the shelf holding assembly 1600 (see FIGS. 1 to 3 and 6). The body 1710, as illustrated in FIG. 4, may be formed in a hexahedral shape with an opening 1710*a*, but may not necessarily be limited to the hexahedral shape.

The body 1710 may be formed in a manner of coupling a first body 1711 and a second body 1712 to each other. The first body 1711 forms a part of the body 1710 and the second body 1712 forms the other part of the body 1710. For example, the first body 1711 forms four faces of the hexahedron except for the opening 1710*a*, and the second body 1712 may form one face of the hexahedron except for the opening 1710*a*. If the opening 1710*a* is a front surface, the first body 1711 may form upper, lower, left and rear surfaces of the hexahedron and the second body 1712 may form a right surface.

The opening 1710*a* of the body 1710 is an area for an insertion of a shelf terminal unit 1900 to be explained later. The opening 1710*a* is open toward the food storage chamber 1200 illustrated in FIG. 1.

A protruded coupling portion 1711*c* is formed on an upper end of the body 1710 and a recessed coupling portion 1711*c*' may be formed on a lower end of the body 1710. The positions of the protruded coupling portion 1711*c* and the recessed coupling portion 1711*c*' may be switched with each other. The protruded coupling portion 1711*c* and the recessed coupling portion 1711*c*' are components for mutual coupling between two different holder terminal units 1700.

The body 1710 is provided with shelf holder coupling protrusions 1711*a* and 1712*a* on both side surfaces. Cut portions 1711*a*' and 1712*a*' each having a shape like '⊏' are formed on the both side surfaces of the body 1710, and the shelf holder coupling protrusions 1711*a* and 1712*a* each in a cantilevered shape are formed. The shelf holder coupling protrusions 1711*a* and 1712*a* may protrude from the side surfaces of the first body 1711 and the second body 1712 in a direction of getting away from the side surfaces and thus form steps from the side surfaces of the body 1710. Accordingly, the shelf holder coupling protrusions 1711*a* and 1712*a* can be inserted or locked in the terminal unit coupling hole 1621*a*, 1621*b*, 1621*c*, 1621*d*, 1621*e*, 1621*f* (see FIG. 3) and a terminal unit coupling hole 1622*a*, 1622*b*, 1622*c*, 1622*d*, 1622*e*, 1622*f* to be explained with reference to FIG. 6. Also, each of the shelf holder coupling protrusions 1711*a* and 1712*a* may have a tilt on an outer surface thereof to be easily inserted into the shelf holding assembly 1600 (see FIGS. 1 to 3 and 6).

When the holder terminal unit 1700 is introduced toward the rear side of the shelf holding assembly 1600, the two shelf holder coupling protrusions 1711*a* and 1712*a* are pushed in a direction of getting close to each other by the inner side surfaces of the shelf holding assembly 1600. The tilts of the shelf holder coupling protrusions 1711*a* and 1712*a* can prevent the introduction of the holder terminal unit 1700 from being interfered due to the shelf holding assembly 1600.

The shelf holder coupling protrusions 1711*a* and 1712*a* are inserted up to positions facing the terminal unit coupling holes 1621*a*, 1621*b*, 1621*c*, 1621*d*, 1621*e*, 1621*f*, 1622*a*, 1622*b*, 1622*c*, 1622*d*, 1622*e* and 1622*f* of the shelf holding assembly 1600, the pushed shelf holder coupling protrusions 1711*a* and 1712*a* are inserted into the terminal unit coupling holes 1621*a*, 1621*b*, 1621*c*, 1621*d*, 1621*e*, 1621*f*, 1622*a*, 1622*b*, 1622*c*, 1622*d*, 1622*e* and 1622*f*. Accordingly, the steps of the shelf holder coupling protrusions 1711*a* and 1712*a* are locked on inner circumferential surfaces of the terminal unit coupling holes 1621*a*, 1621*b*, 1621*c*, 1621*d*, 1621*e*, 1621*f*, 1622*a*, 1622*b*, 1622*c*, 1622*d*, 1622*e* and 1622*f*, and the holder terminal unit 1700 is coupled to the shelf holding assembly 1600.

When desiring to separate the holder terminal unit 1700 from the shelf holding assembly 1600, the two shelf holder coupling protrusions 1711*a* and 1712*a*, which are exposed through the terminal unit coupling holes 1621*a*, 1621*b*, 1621*c*, 1621*d*, 1621*e*, 1621*f*, 1622*a*, 1622*b*, 1622*c*, 1622*d*, 1622*e* and 1622*f* are pushed to be close to each other to unlock the steps. Accordingly, in the closely-pushed state of the shelf holder coupling protrusions 1711*a* and 1712*a*, the body 1710 is pulled away from the rear of the shelf holding assembly 1600.

The two shelf hold coupling protrusions 1711*a* and 1712*a* may be formed at different heights. The two shelf holder coupling protrusions 1711*a* and 1712*a* with the different heights allow for identifying left and right sides of the holder terminal unit 1700. As the two shelf holder coupling protrusions 1711*a* and 1712*a* are formed at the different heights, the user can identify the left and right sides of the holder terminal unit 1700. This may prevent the holder terminal unit 1700 from being coupled to the shelf holding assembly 1600 in a turned-over state. The terminal unit coupling holes 1621*a*, 1621*b*, 1621*c*, 1621*d*, 1621*e* and 1621*f* which are formed on the left portion 1621 of the shelf holding assembly 1600 are formed at heights corresponding to the shelf holder coupling protrusion 1711*a* which is formed on the left surface of the body 1710. Similarly, the terminal unit coupling holes 1622*a*, 1622*b*, 1622*c*, 1622*d*, 1622*e* and 1622*f* which are formed on the right portion 1622 of the shelf holding assembly 1600 are formed at heights corresponding to the shelf holder coupling protrusion 1711*a* which is formed on the right surface of the body 1710.

The body 1710 is provided with drain holes 1711*b* and 1712*b* through which water filled or condensed in the body 1710 is drained out. Since moisture is always present in the refrigerator 1000, condensed water may be generated when internal temperature of the food storage chamber 1200 is dropped below the dew point. This may also be caused in the holder terminal unit 1700. The opening 1710*a* of the holder terminal unit 1700 is obscured by the cover 1750 (see FIGS. 2 and 7), it is impossible to fundamentally prevent water from being collected in the body 1710.

The drain holes 1711*b* and 1712*b* allow the inside and outside of the body 1710 to communicate with each other. The drain holes 1711*b* and 1712*b* are preferably formed on the both side surfaces of the body 1710. This is because the front surface (i.e., the opening 1710*a*) of the body 1710 is obscured by the cover 1750 illustrated in FIG. 2 and the holder-side wire 1730 is disposed on the rear surface of the body 1710. The drain holes 1711*b* and 1712*b* are formed in order to drain out water which is likely to cause a defect of an electric contact between the holder terminal unit 1700 and the shelf terminal unit 1900. Therefore, it is not preferable to drain water out toward the holder-side wire 1730.

Also, the drain holes 1711*b* and 1712*b* are preferably formed on the lower portion of the body 1710, as illustrated in FIG. 4. In order for the water filled in the body 1710 to flow toward the drain holes by its own weight, the drain holes 1711*b* and 1712*b* are preferably formed at positions in parallel to or lower than the bottom surface of the body 1710. In this instance, the positions in parallel to or lower than the bottom surface correspond to the lower portion of the body 1710.

The protruded coupling portion 1711*c* protrudes from an upper end of the body 1710 in a tilted state. The recessed coupling portion 1711*c*' is recessed into a lower end of the body 1710 in a tilted state to correspond to the protruded coupling portion 1711*c*. The two holder terminal units 1700 may be coupled to each other in a manner that the protruded coupling portion 1711*c* of one of the two holder terminal units 1700 is inserted into the recessed coupling portion 1711*c*' of the other holder terminal unit 1700.

Since the protruded coupling portion 1711*c* and the recessed coupling portion 1711*c*' are tilted, the coupling of the two holder terminal units 1700 may be implemented in a manner that the protruded coupling portion 1711*c* is inserted into the recessed coupling portion 1711*c*' in a sliding manner.

The protruded coupling portion 1711*c* and the recessed coupling portion 1711*c*' may not always have to have the tilted shape. The protruded coupling portion 1711*c* and the recessed coupling portion 1711*c*' may not be limited to any shape if the two holder terminal units 1700 can be coupled to each other. For example, the protruded coupling portion 1711*c* and the recessed coupling portion 1711*c*' may also have a shape like an alphabet 'T', in addition to the tilted shape.

Figure 7:
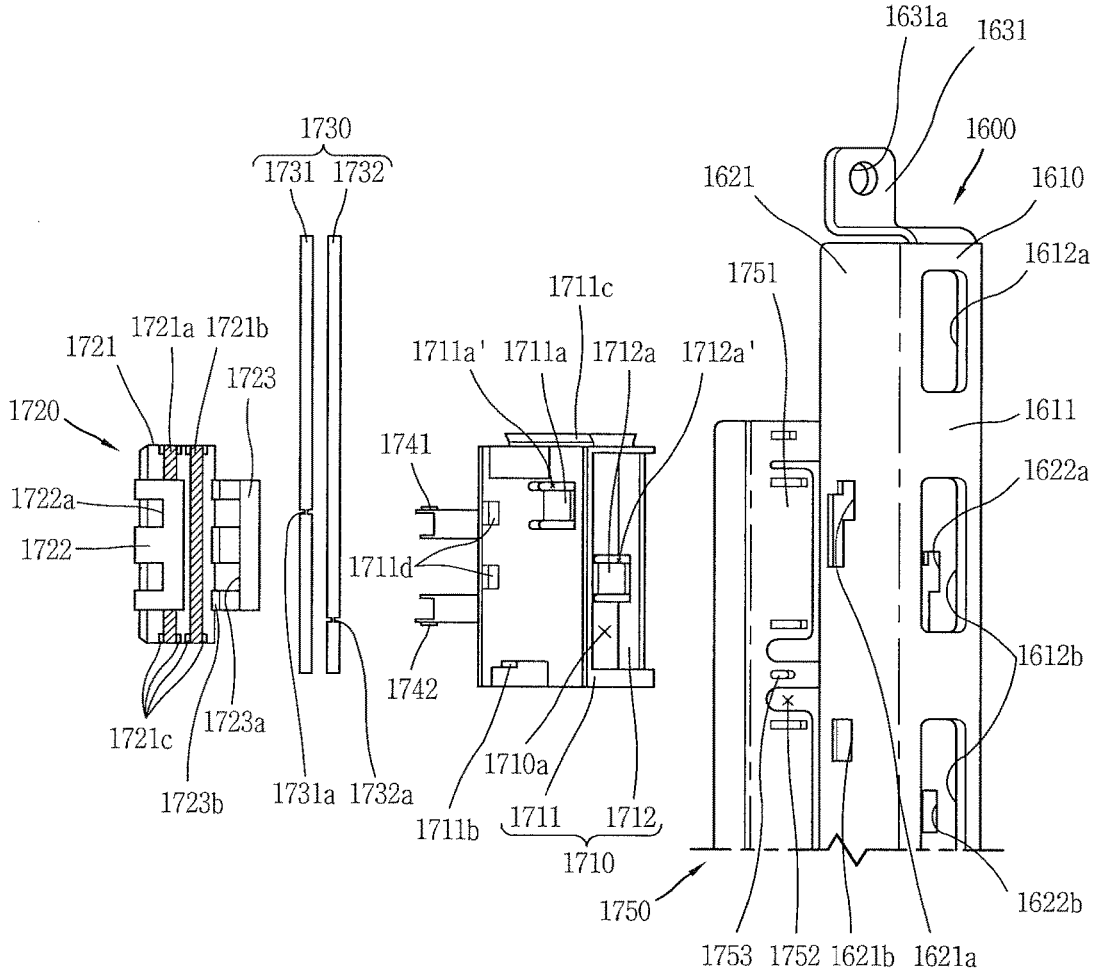
FIG. 7 is a diagram illustrating an example of a disassembled perspective view of the shelf holder and the holder terminal unit.

The body 1710 is coupled to the body cover 1720. The body 1710 is provided with body cover coupling protrusions 1712*d* (and 1711*d* illustrated in FIG. 7) on outer side surfaces thereof, in order to be coupled to the body cover 1720. The body cover coupling protrusions 1712*d* protrude from both (outer) side surfaces of the body 1710. The body cover coupling protrusions 1711*d* which are formed on the left side surface of the body 1710 are illustrated in FIG. 7. The body cover coupling protrusions 1711*d* and 1712*d* may form steps from the side surfaces of the body 1710, to be inserted and locked in body coupling holes 1722*a* (see FIGS. 7) and 1723*a* of the body cover 1720.

The body cover coupling protrusions 1711*d* and 1712*d* each may be formed in a cantilevered shape, similar to the shelf holder coupling protrusions 1711*a* and 1712*a*. Also, unlike the shelf holding assembly 1600, a left cover portion 1722 and a right cover portion 1723 (see FIG. 7) of the body cover 1720 may be open in a direction of getting away from each other, and thus the body cover coupling protrusions 1711*d* and 1712*d* may also protrude from the outer side surfaces of the body 1710, instead of having the cantilevered shape. The body cover coupling protrusions 1711*d* and 1712*d* may be tilted, similar to the shelf holder coupling protrusions 1711*a* and 1712*a*.

The body cover 1720 covers the body 1710. The body cover 1720 may be formed in a shape like '⊏' to surround the both side surfaces and the rear surface of the body 1710. The body cover 1720 is coupled to the body 1710 with interposing the holder-side wire 1730 therebetween, so as to fix the holder-side wire 1730.

The body cover 1720 is provided with body coupling holes 1723*a* and 1722*a* (see FIG. 7) on both side surfaces thereof to correspond to the body cover coupling protrusions 1711*d* and 1712*d* (see FIG. 7). The body coupling holes 1722*a* and 1723*a* may partially accommodate the body cover coupling protrusions 1711*d* and 1712*d*, respectively, to lock the body cover coupling protrusions 1711*d* and 1712*d*.

The coupling between the body cover 1720 and the body 1710 is similar to the coupling between the body 1710 and the shelf holding assembly 1600. When the body cover 1720 meets the body cover coupling protrusions 1711*d* and 1712*d* in response to being moved close to the rear of the body 1710, both side surfaces of the shape like '⊏' are open in a direction of getting away from each other. In this instance, since the body cover coupling protrusions 1711*d* and 1712*d* are tilted, the body cover 1720 may continuously be moved close to the body 1710, without the interference with the body cover coupling protrusions 1711*d* and 1712*d*. The body cover coupling protrusions 1711*d* and 1712*d* are locked in the body coupling holes 1722*a* and 1723*a*, and the both side surfaces of the body cover 1720 which have been open are closed and thus the body cover 1720 is restored to its original state. Accordingly, the body cover 1720 and the body 1710 are coupled to each other.

The holder-side wire 1730 is disposed at the rear of the body 1710. The holder-side wire 1730 is covered by the body cover 1720. Accordingly, the holder-side wire 1730 is disposed between the body 1710 and the body cover 1720. The holder-side wire 1730 is connected to a power supply unit of the refrigerator main body 1100. The holder-side wire 1730 includes two holder-side wires 1731 and 1732 which are connected to a positive (+) pole and a negative (−) pole of the power supply unit, respectively.

Figure 5:
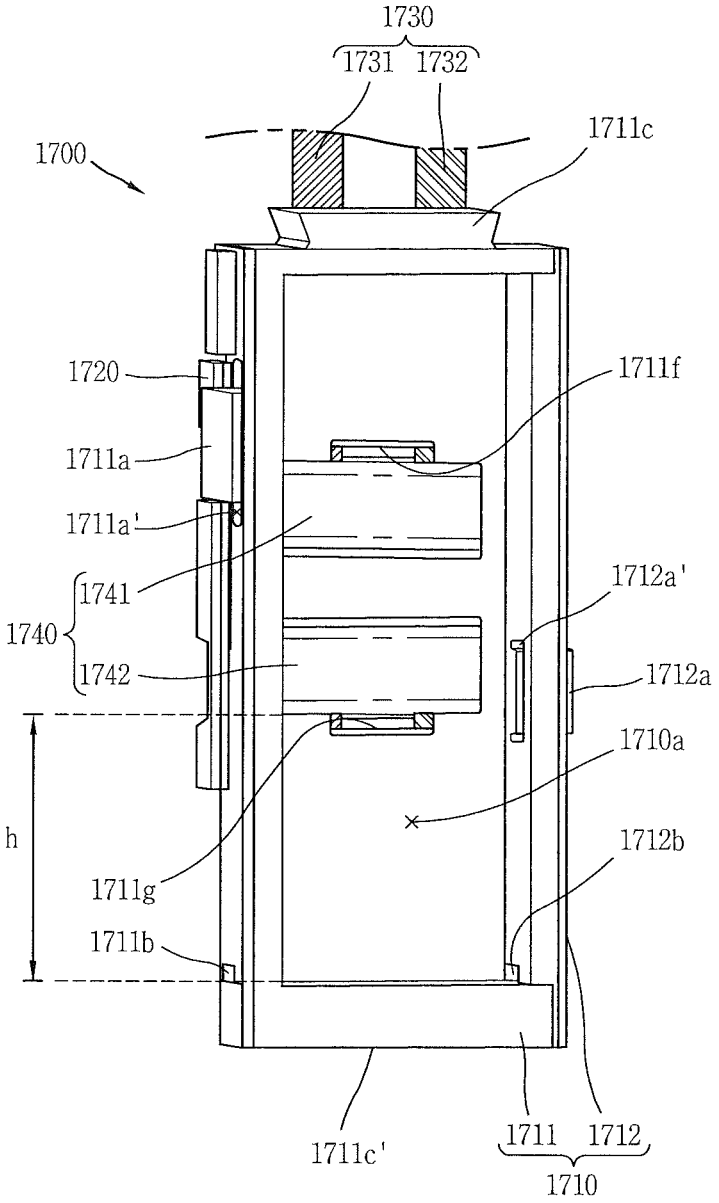
FIG. 5 is a diagram illustrating an example of the holder terminal unit illustrated in FIG. 4, viewed from a different direction.

FIG. 5 is a diagram illustrating an example of the holder terminal unit 1700 illustrated in FIG. 4, viewed from a different direction.

Viewing an inside of the holder terminal unit 1700 through the opening 1710*a*, it can be seen that a holder-side terminal 1740 is coupled to the body 1710. The holder-side terminal 1740 is fixed to the body 1710 and partially exposed to the inside of the body 1710.

The holder-side terminal 1740 includes two holder-side terminals 1741 and 1742 which are partially connected to the two holder-side wires 1731 and 1732 through the body 1710. If the two holder-side terminals 1741 and 1742 are referred to as a first holder-side terminal 1741 and a second holder-side terminal 1742 and the two holder-side wires 1731 are referred to as a first holder-side wire 1731 and a second holder-side wire 1732, the first holder-side terminal 1741 is connected to the first holder-side wire 1731 and the second holder-side terminal 1742 is connected to the second holder-side wire 1732.

The first holder-side terminal 1741 and the second holder-side terminal 1742 may be disposed with being spaced apart from each other in an up and down direction. A detailed structure of the two holder-side terminals 1741 and 1742 will be described later with reference to FIG. 8.

The holder-side terminal 1740 is spaced apart from a bottom surface of the body 1710. The holder-side terminal 1740 is disposed at a higher position than the bottom surface of the body 1710. The holder-side terminal 1740 has a height difference (h) from the bottom surface of the body 1710.

As aforementioned, water may be likely to be filled within the body 1710. When the water is brought into contact with the holder-side terminal, a defective electric contact may be caused. When the holder-side terminal 1740 is spaced apart from the bottom surface of the body 1710, the contact of the holder-side terminal 1740 with the water can be prevented. Also, as aforementioned, the water filled in the body 1710 can be drained out through the drain holes 1711*b* and 1712*b*.

The body 1710 is provided with through holes 1711*e* and 1711*f* through which the two holder-side terminals 1741 and 1742 are inserted. The through holes 1711*e* and 1711*f* communicate from inside to outside of the body 1710 through the rear surface of the body 1710. The holder-side terminals 1741 and 1742 may be exposed to the rear surface of the body 1710 through the through holes 1711*e* and 1711*f*.

The through holes 1711*e* and 1711*f* are formed such that the holder-side terminal 1740 in the shape like '⊏' is inserted therethrough. The upper through hole 1711*e* of the two through holes 1711*e* and 1711*f* has an area which additionally communicates with the inside and outside of the body 1710 in an upward direction. The lower through hole 1711*f* of the two through holes 1711*e* and 1711*f* has an area which additionally communicates with the inside and outside of the body 1710 in a downward direction. The additionally-communicating areas are areas through which stopping portions 1741*d* and 1742*d* (see FIGS. 6 and 8) of the holder-side terminal pass. The stopping portions 1741*d* and 1742*d* of the holder-side terminal 1740 will be described later.

Figure 6:
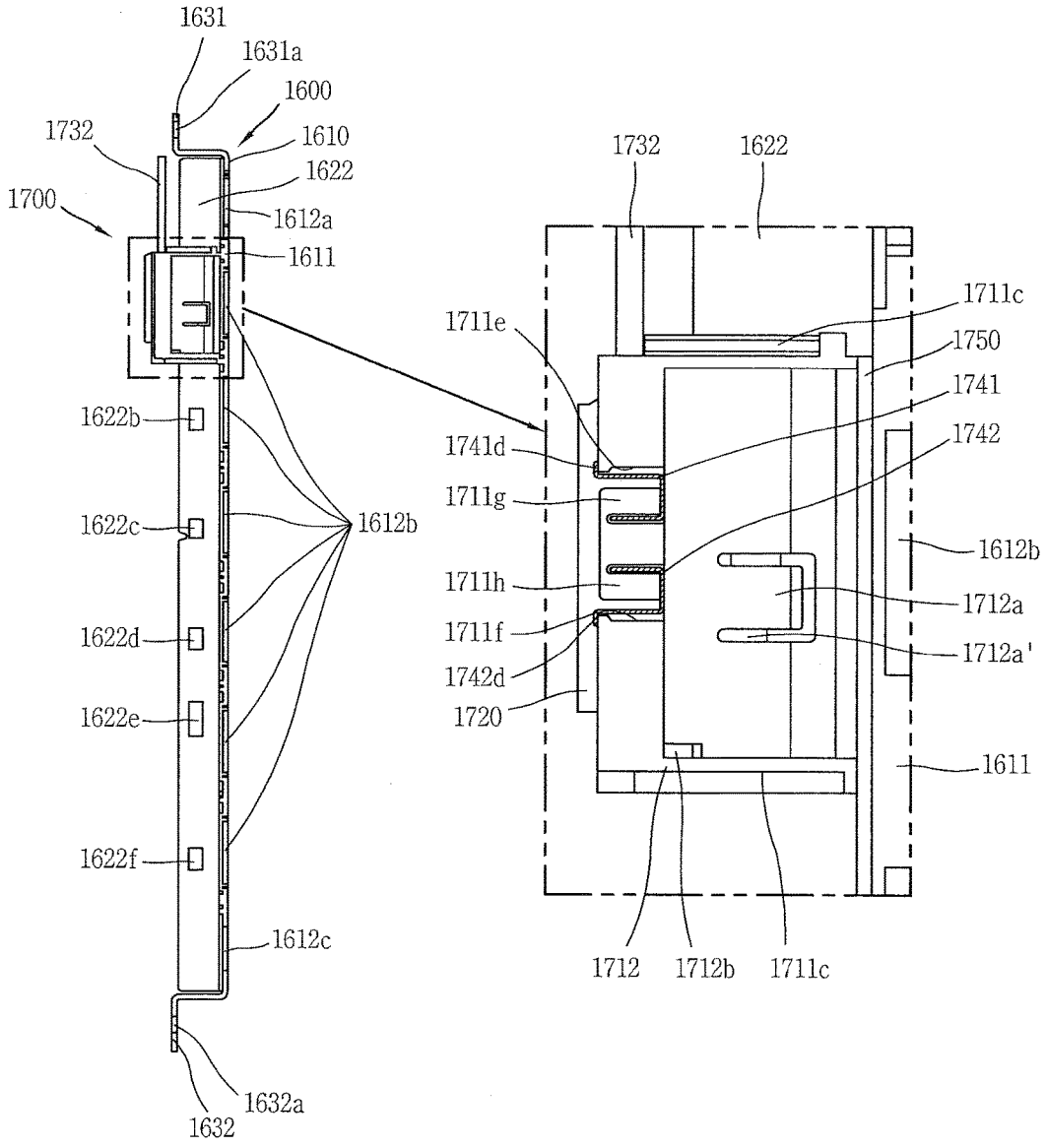
FIG. 6 is diagram illustrating an example of a longitudinal sectional view of the shelf holder and the holder terminal unit, taken along the line A-A of FIG. 2 and viewed from a side surface.

FIG. 6 is a diagram illustrating an example of a longitudinal view of the shelf holding assembly 1600 and the holder terminal unit 1700, taken along the line A-A of FIG. 2 and viewed from a side surface.

When the shelf holding assembly 1600 and the holder terminal unit 1700 are cut in a longitudinal direction and viewed from the left side, the right portion 1622 of the shelf holding assembly 1600 can be visually viewed. The right portion 1622 of the shelf holding assembly 1600 is bent from the front portion 1610 of the shelf holding assembly 1600 toward the rear wall 1622 of the food storage chamber 1200. The right portion 1622 of the shelf holding assembly 1600 extends in the up and down direction, similar to the front portion 1610 of the shelf holding assembly 1600.

The right portion 1622 of the shelf holding assembly 1600, similar to the left portion 1621 (see FIGS. 2 and 3), is also provided with the terminal unit coupling holes 1622*a*, 1622*b*, 1622*c*, 1622*d*, 1622*e* and 1622*f*.

The terminal unit coupling holes 1622*a*, 1622*b*, 1622*c*, 1622*d*, 1622*e* and 1622*f* are spaced apart from one another in an up and down direction. On the other hand, the terminal unit coupling holes 1622*a*, 1622*b*, 1622*c*, 1622*d*, 1622*e* and 1622*f* are arranged at the same position in a left and right direction. When drawing a virtual line in a vertical direction in FIG. 6, it can be noticed that the terminal unit coupling holes 1622*a*, 1622*b*, 1622*c*, 1622*d*, 1622*e* and 1622*f* are not misaligned with one another. Therefore, the location of the holder terminal unit 1700 may change based on to which of the terminal unit coupling holes 1622*a*, 1622*b*, 1622*c*, 1622*d*, 1622*e* and 1622*f* the holder terminal unit 1700 is coupled.

The holder terminal unit 1700 is coupled to the shelf holding assembly 1600, and the holder terminal unit 1700 is disposed at a location corresponding to the hole 1612*b* of the shelf holding assembly 1600. Accordingly, the two holder-side terminals 1741 and 1742 are disposed to face the hole 1612*b* which is formed on the front portion 1610 of the shelf holding assembly 1600.

Explaining the holder-side terminals 1741 and 1742 in an enlarged view provided at a right side of FIG. 6, each of the holder-side terminals 1741 and 172 has a section in a shape like '⊏'. The through holes 1711*e* and 1711*f* of the body 1710 may be formed in a shape like '⊏' to correspond to the holder-side terminals.

The body 1710 is provided with terminal coupling portions 1711*g* and 1711*h* disposed on the rear surface and extending in a left and right direction. Although the shapes of the terminal coupling portions 1711*g* and 1711*h* are not sufficiently illustrated in the longitudinal view of FIG. 6, referring to FIGS. 5 and 6, it can be predicted that the terminal coupling portions 1711*g* and 1711*h* extend in the left and right direction. The through holes 1711*e* and 1711*f* are formed on peripheries of the terminal coupling portions 1711*g* and 1711*h*.

Assuming that a direction that the terminal coupling portions 1711*g* and 1711*h* face the hole 1612*b* of the shelf holding assembly 1600 is referred to as a front surface, the holder-side terminals 1741 and 1742 surround front, upper and lower sides of the terminal coupling portions 1711*g* and 1711*h*. The holder-side terminals 1741 and 1742 extend toward the rear surface of the body 1710. Specifically, the holder-side terminals 1741 and 1742 extend up to the outside of the body 1710, bent at the outside of the body 1710, and locked on the rear surface of the body 1710. The stopping portion 1741*d* of the first holder-side terminal 1741 is bent upwardly to be locked on the rear surface of the body 1710.

The stopping portion 1742*d* of the second holder-side terminal 1742 is bent downwardly to be locked on the rear surface of the body 1710.

To ensure reliability of an electric connection of the holder-side terminals 1741 and 1742, the holder-side terminals 1741 and 1742 should maintain an electrically-connected state with the holder-side wires 1731 (see FIGS. 2 to 5 and 7 to 8) and 1732, and the locations of the holder-side terminals 1741 and 1742 should be fixed although a physical impact is applied thereto during mounting of the shelf terminal unit 1900.

When widths of the holder-side terminals 1741 and 1742 in the up and down direction are smaller than widths of the terminal coupling portions 1711*g* and 1711*h* in the up and down direction, the holder-side terminals 1741 and 1742 are affected by force in a direction of getting open due to the terminal coupling portions 1711*g* and 1711*h*. Therefore, the locations of the holder-side terminals 1741 and 1742 can be fixed. Also, as the stopping portions 1741*d* and 1742*d* of the holder-side terminals 1741 and 1742 are locked on the rear surface of the body 1710, the locations of the holder-side terminals 1741 and 1742 can be fixed.

FIG. 7 is a diagram illustrating an example of a disassembled perspective view of the shelf holding assembly 1600 and the holder terminal unit 1700.

The body cover 1720 includes a rear surface cover portion 17201, a left cover portion 1722 and a right cover portion 1723.

The rear surface cover portion 1721 covers the rear surface of the body 1710. The rear surface cover portion 1721 is disposed to face the rear surface of the body 1710.

The rear surface cover portion 1721 is provided with wire receiving grooves 1721*a* and 1721*b*. The wire receiving grooves 1721*a* and 1721*b* of the rear surface cover portion 1721 are formed by being recessed at locations facing the rear surface of the body cover 1720 to correspond to appearance of the two holder-side terminals 1731 and 1732. The wire receiving grooves 1721*a* and 1721*b* of the rear surface cover portion 1721 may extend in an up and down direction along an extending direction of the two holder-side wires 1731 and 1732. The two holder-side wires 1731 and 1732 may partially or all be received in the wire receiving grooves 1721*a* and 1721*b* of the rear surface cover portion 1721.

In some implementations, the body 1710 may also be provided with wire receiving grooves at locations corresponding to the wire receiving grooves 1721*a* and 1721*b* of the body cover 1720. The wire receiving grooves of the body 1710 form an arrangement space of the two holder-side wires 1731 and 1732 together with the wire receiving grooves 1721*a* and 1721*b* of the body cover 1720.

The rear surface cover portion 1721 is provided with location fixing protrusions 1721*c*. The location fixing protrusions 1721*c* protrude from peripheries of the wire receiving grooves 1721*a* and 1721*b*. The location fixing protrusions 1721*c* may be formed on upper and lower ends of the rear surface cover portion 1721, as illustrated in FIG. 7. However, implementations are not be limited to this. The location fixing protrusions 1721*c* may be formed on any locations of the peripheries of the wire receiving grooves 1721*a* and 1721*b*.

If each holder-side wire 1731 and 1732 is thick in thickness, the rear surface of the body 1710 and the rear surface cover portion 1721 may be spaced apart from each other and the holder-side wires 1731 and 1732 may be likely to be separated from the wire receiving grooves 1721*a* and 1721*b* and wire receiving grooves of the body 1710. However, if the location fixing protrusions 1721*c* restrict the movements of the holder-side wires 1731 and 1732 at the left and right sides of the holder-side wires 1731 and 1732, the locations of the holder-side wires 1731 and 1732 may be fixed.

The left cover portion 1722 covers the left surface of the body 1710. The right cover portion 1723 covers the right surface of the body 1710. The left cover portion 1722 and the right cover portion 1723 extend from the rear surface cover portion 1721 in a direction in parallel to the side surface of the body 1710.

In some implementations, a reinforcing rib may be provided on a connected portion between the left cover portion 1722 and the rear surface cover portion 1721. A reinforcing rib 1723*b* may also be provided on a connected portion between the right cover portion 1723 and the rear surface cover portion 1721. The reinforcing rib 1723*b* may be additionally attached to the connected portion between the rear surface cover portion 1721 and the left cover portion 1722 or to the connected portion between the rear surface cover portion 1721 and the right cover portion 1723. The reinforcing rib 1723*b* may be integrally formed with the body cover 1720.

When the body cover 1720 is repetitively coupled to or separated from the body 1710, the left cover portion 1722 and the right cover portion 1723 may be liked to be cut off from the rear surface cover portion 1721. The reinforcing rib 1723*b* can solve such concern by reinforcing the connection between the rear surface cover portion 1721 and the left cover portion 1722 and the connection between the rear surface cover portion 1721 and the right cover portion 1723.

The left cover portion 1722 and the right cover portion 1723 are provided with body coupling holes 1722*a* and 1723*a*, respectively. The insertion and lock of the body cover coupling protrusions 1711*d* and 1712*d* into the body coupling holes 1722*a* and 1723*a* have been described above.

The holder-side terminals 1741 and 1742 are inserted through the body 1710 and exposed to the rear surface of the body 1710. Since the holder-side wires 1731 and 1732 are disposed at the rear surface of the body 1710, the holder-side terminals 1741 and 1742 exposed to the rear surface of the body 1710 are brought into contact with the holder-side wires 1731 and 1732.

The holder-side wires 1731 and 1732 are provided with coating members 1731*b* and 1732*b* (see FIG. 8) for insulation, and conductive members 8131*c* and 1732*c* (see FIG. 8) within the coating members 1731*b* and 1732*b*, respectively. Therefore, in order for the holder-side terminals 1741 and 1742 to be connected to the power supply unit of the refrigerator main body 1100 (see FIG. 1) through the holder-side wires 1731 and 1732, the holder-side terminals 1741 and 1742 should be brought into contact with the conductive members 1731*c* and 1732*c* of the holder-side wires 1731 and 1732.

The holder-side terminals 1741 and 1742 are partially inserted into the coating members 1731*b* and 1732*b* of the holder-side wires 1731 and 1732. The inserted portions of the holder-side terminals 1741 and 1742 may be brought into contact with the conductive members 1731*c* and 1732*c*. FIG. 7 illustrates a state that the holder-side terminals 1741 and 1742 are inserted into the coating members 1731*b* and 1732*b* of the holder-side wires 1731 and 1732 and then are separated from the holder-side wires 1731 and 1732 again.

As the first holder-side terminal 1741 is inserted into the coating member 1731*b* of the first holder-side wire 1731 and then is separated from the first holder-side wire 1731, the coating member 1731*b* of the first holder-side wire 1731 is partially damaged and the conductive member 1731*c* within the coating member 1731*b* is visually exposed to outside. It can be noticed at a portion indicated with a reference numeral 1731*a*.

Also, as the second holder-side terminal 1742 is inserted into the coating member 1732*b* of the second holder-side wire 1732 and then is separated from the second holder-side wire 1732, the coating member 1732*b* of the second holder-side wire 1732 is partially damaged and the conductive member 1732*c* within the coating member 1732*b* is visually exposed to outside. It can be noticed at a portion indicated with a reference numeral 1732*a*.

A cover 1750 is disposed between the body 1710 and the shelf holding assembly 1600. The cover 1750 extends in the up and down direction, similar to the shelf holding assembly 1600.

The opening 1710*a* is formed at the front surface of the body 1710, and the shelf holding assembly 1600 is provided with the hole 1612*b* corresponding to the opening 1710*a* of the body 1710. Therefore, the holder-side terminals 1741 and 1742 may be exposed to the food storage chamber 1200 (see FIG. 1) through the hole 1612*b* and the opening 1710*a*. When the holder-side terminals 1741 and 1742 are exposed to the food storage chamber 1200, it may be affected by moisture and also exposed to a physical impact.

The cover 1750 is configured to block the opening 1710*a* of the body 1710 and the hole 1612*b* of the shelf holding assembly 1600. Since the cover 1750 blocks the opening 1710*a* of the body 1710 and the hole 1612*b* of the shelf holding assembly 1600, a direct exposure of the holder-side terminals 1741 and 1742 to the moisture or the physical impact can be prevented.

The cover 1750 includes a cut portion 1752 through which a shelf terminal unit 1900 to be explained later is inserted. The cut portion 1752 may be formed in a shape of a straight line extending in a vertical direction, or in a shape of additionally extending along a horizontal direction from both end portions of the vertically-extended line.

Also, the cut portion 1752 may be formed in a shape like '⊏,' as illustrated in FIG. 7. As the cut portion 1752 is formed in the shape line '⊏,' the cover 1750 includes a door 1751 in a cantilevered shape. When the door 1750 has the cantilevered shape, the shelf terminal unit 1900 to be explained later can be prevented from being caught in the cover 1750.

The door 1751 which has the cantilevered shape may thus be pushed inwardly by the shelf terminal unit 1900. When the shelf terminal unit 1900 is inserted into the hole 1612*b* of the shelf holding assembly 1600, the door 1751 may receive external force by the shelf terminal unit 1900. A free end of the door 1751 may be moved and the fixed end of the door 1751 is fixed to the other portion of the cover 1750. Accordingly, the door 1751 can be pushed inwardly by the external force. In some implementations, the door 1751 is to be pushed inwardly toward the left surface of the body 1710. For pushing inwardly and restoring the door 1751, the cover 1750 is preferably formed of an elastic material.

A location setting groove 1753 is formed on the front surface of the cover 1750. In some implementations, the shelf holding assembly 1600 is provided with a protrusion corresponding to the location setting groove 1753 of the cover 1750. The protrusion of the shelf holding assembly 1600 is formed on a surface facing the cover 1750. A location where the protrusion of the shelf holding assembly 1600 is inserted into the location setting groove 1753 of the cover 1750 corresponds to a coupling location between the cover 1750 and the shelf holding assembly 1600.

When the body 1710 and the body cover 1720 are coupled to each other with the holder-side wires 1731 and 1732 interposed therebetween, the holder-side terminals 1741 and 1742 coupled to the body 1710 are electrically connected to the holder-side wires 1731 and 1732, and the holder terminal unit 1700 is implemented accordingly. When the holder terminal unit 1700 is coupled to the shelf holding assembly 1600 with the cover 1750 interposed therebetween, a preparation for an electric connection with the shelf terminal unit 1900 to be explained later is completed.

Figure 8:
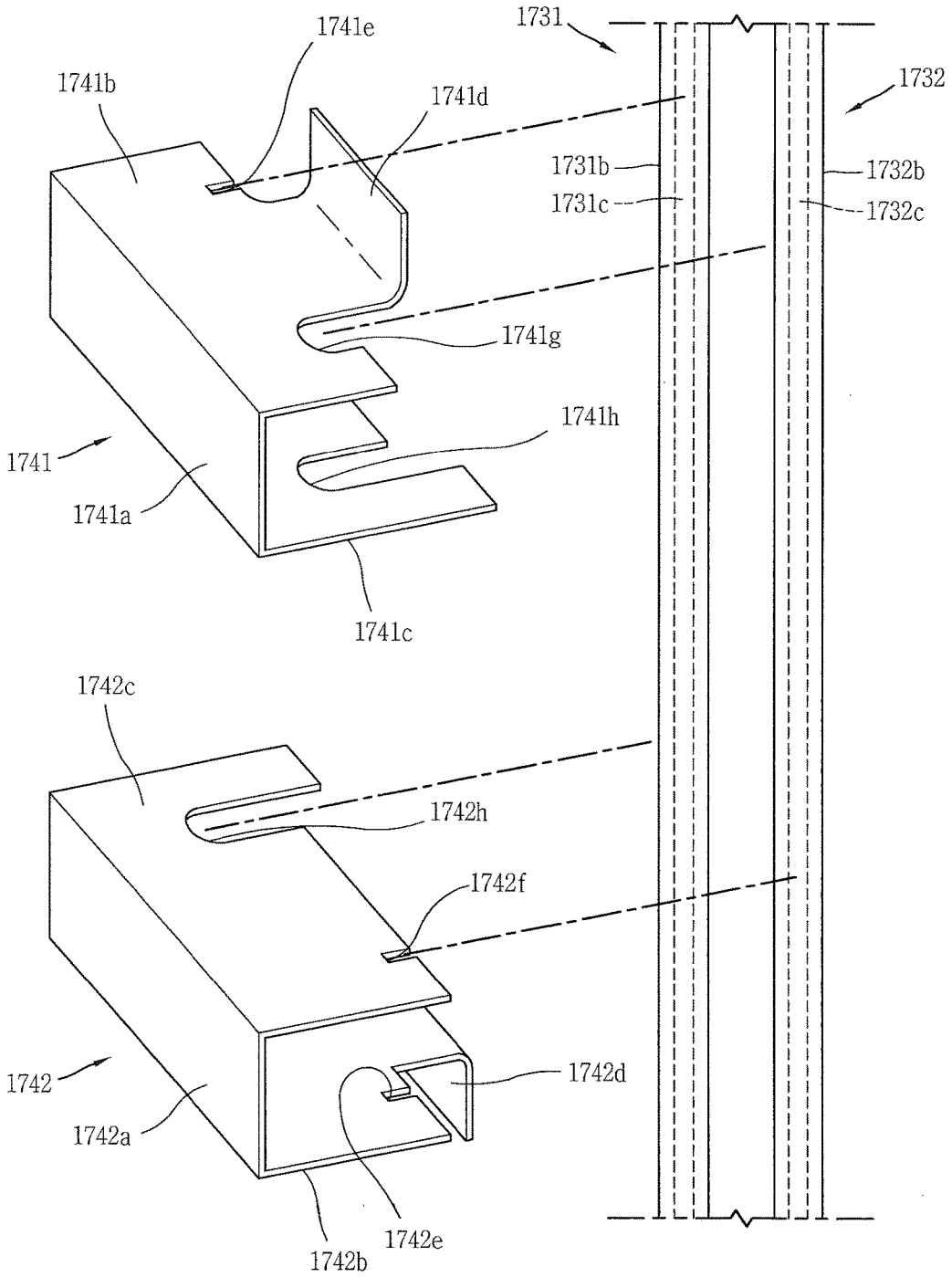
FIG. 8 is a diagram illustrating an example of a perspective view of a holder-side terminal illustrated in FIG. 7.

FIG. 8 is a diagram illustrating an example of a perspective view of the holder-side terminals 1741 and 1742 illustrated in FIG. 7.

The holder-side terminal 1740 includes the first holder-side terminal 1741 and the second holder-side terminal 1742. The first holder-side terminal 1741 is electrically connected to the first holder-side wire 1731, and the second holder-side terminal 1742 is electrically connected to the second holder-side wire 1732.

The first holder-side terminal 1741 and the second holder-side terminal 1742 may have the same shape. Referring to FIG. 8, the second holder-side terminal 1742 may have the shape that the first holder-side terminal 1741 is turned over. In this specification, unless otherwise explicitly dividing the first holder-side terminal 1741 and the second holder-side terminal 1742, the holder-side terminal 1740 may include both of the first holder-side terminal 1741 and the second holder-side terminal 1742.

The first and second holder-side terminals 1741, 1742 include front contact portions 1741*a*, 1742*a*, first extending portions 1741*b*, 1742*b*, second extending portions 1741*c*, 1742*c*, stopping portions 1741*d*, 1742*d*, recessed portions 1741*e*, 1742*e*, 1742*f*, and wire receiving portions 1741*g*, 1741*h*, 1742*h*, respectively.

The front contact portions 1741*a* and 1742*a* are exposed to the inside of the body 1710 (see FIGS. 3 to 7). The front contact portions 1741*a* and 1742*a* are disposed on front surfaces of the terminal coupling portions 1711*g* and 1711*h* (see FIG. 6), and obscure the front surfaces of the terminal coupling portions 1711*g* and 1711*h*. Accordingly, when viewing the inside of the holder terminal unit 1700 through the opening 1710*a* of the body 1710, the front contact portions 1741*a* and 1742*a* can be viewed (see FIG. 5).

The first extending portions 1741*b* and 1742*b* are bent from the front contact portions 1741*a* and 1742*a* and extend toward the rear surface of the body 1710. The second extending portions 1741*c* and 1742*c* are also bent from the front contact portions 1741*a* and 1742*a* and extend toward the rear surface of the body 1710. The first extending portions 1741*b* and 1742*b* and the second extending portions 1741*c* and 1742*c* are disposed to face each other.

The front contact portions 1741*a* and 1741*a*, the first extending portions 1741*b* and 1742*b* and the second extending portions 1741*c* and 1742*c* are coupled to the terminal coupling portions 1711*g* and 1711*h* (see FIG. 6), in a surrounding manner. One side of each of the second extending portions 1741*c* and 1742*c* may extend longer than each of the first extending portions 1741*b* and 1742*b*, so as to prevent separation of the holder-side wires 1731 and 1732 which are received in the wire receiving portions 1741*g*, 1741*h* and 1742*h*.

The stopping portions 1741*d* and 1742*d* are bent and extend from the first extending portions 1741*b* and 1742*b*. The extending direction of the stopping portions 1741*d* and 1742*d* may be a direction in parallel to the front contact portions 1741*a* and 1742*a*. Arranged locations of the stopping portions 1741*d* and 1742*d* correspond to the rear surface of the body 1710. The stopping portions 1741*d* and 1742*d* are locked (stopped) on the rear surface of the body 1710. As the stopping portions 1741*d* and 1742*d* are locked on the rear surface of the body 1710, the holder-side terminals 1741 and 1742 can be prevented from being moved into the body 1710.

The first extending portions 1741*b* and 1742*b* and the second extending portions 1741*c* and 1742*c* are provided with the recessed portions 1741*e*, 1742*e* and 1742*f*. The recessed portions 1741*e*, 1742*e* and 1742*f* have peripheries smaller than the holder-side wires 1731 and 1732. In detail, the peripheries of the recessed portions 1741*e*, 1742*e* and 1742*f* are smaller than the peripheries of the coating members 1731*b* and 1732*b* of the holder-side wires 1731 and 1732.

The recessed portions 1741*e*, 1742*e* and 1742*f* are inserted into the coating members 1731*b* and 1732*b* of the holder-side wires 1731 and 1732 and thus are brought into contact with the conductive members 1731*c* and 1732*c* within the coating members 1731*b* and 1732*b*. Since the recessed portions 1741*e*, 1742*e* and 1742*f* are formed on the first extending portions 1741*b* and 1742*b* and the second extending portions 1741*c* and 1742*c*, the recessed portions 1741*e*, 1742*e* and 1742*f* electrically come in contact with the conductive members 1731*c* and 1732*c* of the holder-side wires 1731 and 1732 at the first extending portions 1741*b* and 1742*b* and the second extending portions 1741*c* and 1742*c*.

The recessed portions 1741*e* and the 1742*e* formed on the first extending portions 1741*b* and 1742*b* and the recessed portions 1742*f* formed on the second extending portions 1741*c* and 1742*c* are formed at the same side based on the stopping portions 1741*d* and 1742*d*. For example, referring to the first holder-side terminal 1741, the recessed portion 1741*e* formed on the first extending portion 1741*b* and the recess portion 1742*e* formed on the second extending portion 1741*c* are all disposed at the left side based on the stopping portion 1741*d*. Therefore, the first holder-side terminal 1741 electrically comes in contact with the conductive member 1731*c* of the first holder-side wire 1731 at the left side of the stopping portion 1741*d*. On the other hand, the second holder-side terminal 1742 electrically comes in contact with the conductive member 1732*c* of the second holder-side wire 1732 at the right side of the stopping portion 1742*d*.

The first extending portions 1741*b* and 1742*b* and the second extending portions 1741*c* and 1742*c* are provided with wire receiving portions 1741*g*, 1741*h* and 1742*h*, respectively. The wire receiving portions 1741*g*, 1741*h* and 1742*h* have peripheries greater than the recess portions 1741*e*, 1742*e* and 1742*f*. The wire receiving portions 1741*g*, 1741*h* and 1742*h* preferably have peripheries which are the same as or greater than those of the coating members 1731*b* and 1732*b* of the holder-side wires 1731 and 1732.

As the wire receiving portions 1741*g*, 1741*h* and 1742*h* have the peripheries which are the same as or greater than those of the coating members 1731*b* and 1732*b* of the holder-side wires 1731 and 1732, the holder-side terminals 1741 and 1742 merely come in contact with the coating members 1731*b* and 1732*b*, without being inserted into the coating members 1731*b* and 1732*b*. Therefore, an electric insulation between the holder-side terminals 1741 and 1742 and the holder-side wires 1731 and 1732 is maintained at the wire receiving portions 1741*g*, 1741*h* and 1742*h*.

The wire receiving portions 1741*g* formed on the first extending portions 1741*b* and 1742*b* and the wire receiving portions 1741*h* and 1742*h* formed on the second extending portions 1741*c* and 1742*c* are located at the same side based on the stopping portions 1741*d* and 1742*d*. For example, referring to the first holder-side terminal 1741, the wire receiving portions 1741*g* formed on the first extending portions 1741*b* and 1742*b* and the wire receiving portions 1741*h* and 1742*h* formed on the second extending portions 1741*c* and 1742*c* are located at the right side based on the stopping portion 1741*d*.

Therefore, the electric insulation between the first holder-side terminal 1741 and the second holder-side wire 1732 is maintained at the right side of the stopping portion 1741*d*. On the other hand, the electric insulation between the second holder-side terminal 1742 and the first holder-side wire 1731 is maintained at the right side of the stopping portion 1742*d*.

With the structure of the holder-side terminals 1741 and 1742, the first holder-side terminal 1741 is electrically connected with the first holder-side wire 1731 and electrically insulated from the second holder-side wire 1732. Also, the second holder-side wire 1742 is electrically connected with the second holder-side wire 1732 and electrically insulated from the first holder-side wire 1731.

The foregoing drawings have illustrated the structure of the shelf holding assembly 1600 and the holder terminal unit 1700. Hereinafter, a shelf assembly 1800 and a shelf terminal unit 1900 both electrically connected to the holder terminal unit 1700 will be described.

Figure 10:
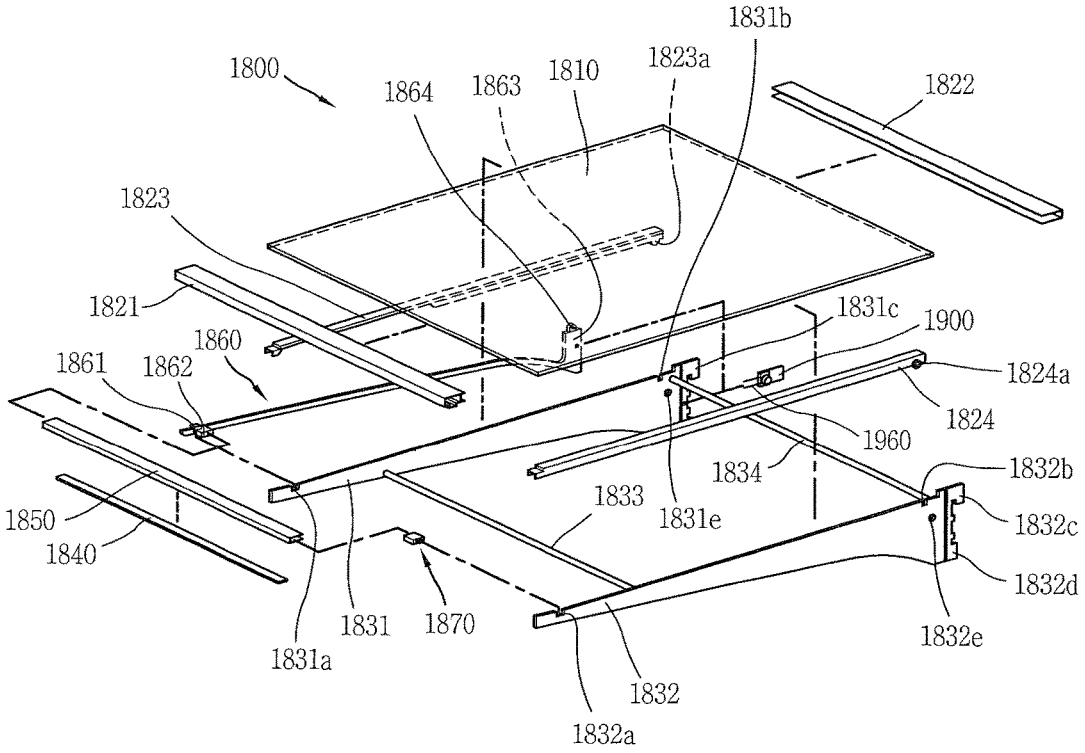
FIG. 10 a diagram illustrating an example of a disassembled perspective view of the shelf assembly illustrated in FIG. 9, and a view of the shelf terminal unit illustrated in FIG. 9.

FIG. 9 is a diagram illustrating an example of a perspective view of the shelf assembly 1800 and the shelf terminal unit 1900, and FIG. 10 illustrates a disassembled perspective view of the shelf assembly 1800 illustrated in FIG. 9, and a view of the shelf terminal unit 1900.

The shelf assembly 1800 includes a shelf 1810. The shelf 1810 is formed in a shape of a plate on which foods and the like are kept. The shelf 1810 may be made of a transparent material for ensuring visibility in an up and down direction. For example, the shelf 1810 may be made of glass or transparent plastic.

The shelf assembly 1800 includes frames 1821, 1822, 1823 and 1824. The frames 1821, 1822, 1823 and 1824 include a front frame 1821, a rear frame 1822, the left frame 1823 and a right frame 1824. The front side is defined as a portion of the shelf assembly 1800, which is located close to a user, based on a direction that the user views the food storing chamber 1200. The left and right sides are also defined based on a direction that the user views the food storage chamber 1200. The rear side refers to a portion of the shelf assembly 1800 which is close to the shelf holding assembly 1600.

If the shelf 1810 is made of glass or plastic, the shelf 1810 may be likely to be broken due to an impact. The front frame 18221, the rear frame 1822, the left frame 1823 and the right frame 1824 are provided to protect edges of the shelf 1810 from impacts, respectively. The front frame 1821, the rear frame 1822, the left frame 1823 and the right frame 1824 have lengths corresponding to the edges of the shelf 1810, respectively.

The front frame 1821 is coupled to the front edge of the shelf 1810, and the rear frame 1822 is coupled to the rear edge of the shelf 1810. Similarly, the left frame 1823 is coupled to the left edge of the shelf 1810, and the right frame 1824 is coupled to the right edge of the shelf 1810. The front frame 1821, the rear frame 1822, the left frame 1823 and the right frame 1824 may cover the edges of the shelf 1810 and support lower surfaces of the edges, respectively.

The left frame 1823 and the right frame 1824 are disposed on brackets 1831 and 1832. The left frame 1823 and the right frame 1824 cover upper portions of the brackets 1831 and 1832.

The left frame 1823 and the right frame 1824 have mounting protrusions 1823*a* and 1824*a* at the rear thereof, respectively. The mounting protrusions 1823*a* and 1824*a* protrude from the rear sides of the left frame 1823 and the right frame 1824, respectively. Since the mounting protrusions 1823*a* and 1824*a* are provided to be mounted to the brackets 1831 and 1832, they protrude downwardly toward the brackets 1831 and 1832. The coupling between the left and right frames 1831 and 1832 and the brackets 1831 and 1832 may alternatively be implemented by using coupling members, such as bolts or other suitable type of coupling member, instead of the mounting protrusions 1823*a* and 1824*a*.

The brackets 1831 and 1832 are installed beneath the shelf 1810 to support the shelf 1810. The brackets 1831 and 1832 includes a left bracket 1831 and a right bracket 1832. The left bracket 1831 and the right bracket 1832 may directly support the shelf 1810 or indirectly support the shelf 1810 by supporting the left frame 1823 and the right frame 1824. FIGS. 9 and 10 illustrate that the left bracket 1831 supports the left frame 1823 and the right bracket 1832 supports the right frame 1824.

Upper portions of the brackets 1831 and 1832 extend in parallel toward the rear of the shelf 1810, but lower portions of the brackets 1831 and 1832 extend toward the rear of the shelf 1810 in a direction of getting away from the upper portion of the shelf 1810. Accordingly, the brackets 1831 and 1832 may generally have a shape of a right triangle, and the lower portions of the brackets 1831 and 1832 may be formed in a curved shape.

Such shape of the brackets 1831 and 1832 facilitates for supporting the front and rear sides of the shelf 1810 when the shelf 1810 is mounted on the shelf holding assembly 1600. The shelf holding assembly 1600 is located at the rear of the shelf assembly 1800. Accordingly, when the shelf assembly 1800 is attached to the shelf holding assembly 1600, the front side of the shelf assembly 1800 is affected by a weight in a downward direction of getting close to the shelf holding assembly 1600, on the basis of the attached point. To support the weight, the brackets 1831 and 1832 have the shape that the lower portion of each bracket extends toward the rear side of the shelf 1810 in a direction of getting away from the upper portion of the shelf 1810.

The brackets 1831 and 1832 are provided on upper portions thereof with first receiving grooves 1831*a* and 1832*a* and second receiving grooves 1831*b* and 1832*b*. The first receiving grooves 1831*a* and 1832*a* and the second receiving grooves 1831*b* and 1832*b* are formed in a manner of being recessed into the upper portions of the brackets 1831 and 1832.

The first receiving grooves 1831*a* and 1832*a* are formed on the front portions of the brackets 1831 and 1832. The first receiving grooves 1831*a* and 1832*a* receive a part of a cap 1870 or a part of a wire cover 1860 to be explained later, so as to support the cap 1870 or the wire cover 1860.

The second receiving grooves 1831*b* and 1832*b* are formed on the rear portions of the brackets 1831 and 1832. The second receiving grooves 1831*b* and 1832*b* receive the mounting grooves 1823*a* and 1824*a* of the left frame 1823 and the right frame 1824, so as to support the mounting protrusions 1823*a* and 1824*a*.

The brackets 1831 and 1832 are provided on rear end portions thereof with hook portions 1831*c* and 1832*c* and inserting portions 1831*d* and 1832*d*, respectively. The hook portions 1831*c* and 1832*c* and the inserting portions 1831*d* and 1832*d* are components required for attaching the shelf assembly 1800 to the shelf holding assembly 1600. The hook portions 1831*c* and 1832*c* are located more above the inserting portions 1831*d* and 1832*d*, and on the other hand, the inserting portion 1831*d* and 1832*d* are located more below the hook portions 1831*c* and 1832*c*.

The hook portions 1831*c* and 1832*c* protrude from the rear sides of the brackets 1831 and 1832 toward the holes 1612*a*, 1612*b* and 1612*c* (see FIGS. 2, 6 and 7) of the shelf holding assembly 1600, and extend downwardly to be mounted on the shelf supporting portions 1611 (see FIGS. 2, 6 and 7) of the shelf holding assembly 1600. The hook portions 1831*c* and 1832*c* are inserted into the holes 1612*a*, 1612*b* and 1612*c* and mounted on the shelf supporting portions 1611.

The inserting portions 1831*d* and 1832*d* protrude from the rear sides of the brackets 1831 and 1832 toward the holes 1612*a*, 1612*b* and 1612*c* (see FIGS. 2, 6 and 7) of the shelf holding assembly 1600. The inserting portions 1831*d* and 1832*d* are inserted into the holes 1612*a*, 1612*b* and 1612*c* and mounted on the shelf supporting portions 1611.

The shelf assembly 1800 may include bars 1833 and 1834 disposed between the left bracket 1831 and the right bracket 1832. The bars 1833 and 1834 may be installed at front and rear sides of the brackets 1831 and 1832. Each of the bars 1833 and 1834 extend in a horizontal direction. One end of each bar 1833 and 1834 is connected to the left bracket 1831 and another end of each bar 1833 and 1834 is connected to the right bracket 1832. Each bar 1833 and 1834 supports surfaces of the left bracket 1831 and the right bracket 1832 that face each other.

The shelf assembly 1800 includes a lighting device 1840 that lights up the food storage chamber 1200 (see FIG. 1). The lighting device 1840 described herein may include every component, such as a fluorescent light, an incandescent light, a light-emitting device (LED), or the like, which emits light. Also, the lighting device 1840 may include a liquid crystal display (LCD) device providing visual information by a backlight unit, and also include a light guiding member for guiding light. Implementations are not limited to any specific shape or type of the lighting device 1840.

The lighting device 1840 is installed at the front of the shelf assembly 1800. If the lighting device 1840 is disposed on an upper surface of the shelf 1810, light generated from the lighting device 1840 may be likely to be transferred directly to the user at a too close location to the user. Therefore, the lighting device 1840 is preferably disposed on a lower surface of the shelf 1810.

A lighting device cover 1850 accommodates the lighting device 1840. For example, the lighting device cover 1850, similar to the front frame 1821, may extend in a left and right direction and the lighting device 1840 may be disposed within the lighting device cover 1850.

The lighting device cover 1850 is installed beneath the shelf 1810. The cap 1870 and the wire cover 1860 are coupled to both ends of the lighting device cover 1850, and accordingly the lighting device cover 1850 can be supported on the brackets 1831 and 1832. The both ends of the lighting device cover 1850 may be open such that the lighting device cover 1850 can be coupled with the cap 1870 and the wire cover 1860.

The shelf assembly 1800 includes the wire cover 1860 and the cap 1870 which close the both ends of the lighting device cover 1850.

The wire cover 1860 protects the shelf-side wires 1961 and 1962 (see FIGS. 11 to 14). The shelf-side wires 1961 and 1962 are connected to the shelf terminal unit 1900 and the lighting device 1840, respectively, to electrically connect the shelf terminal unit 1900 and the lighting device 1840 to each other. Since the shelf-side wires 1961 and 1962 implement the electric connection, it is not preferable to externally expose the shelf-side wires 1961 and 1962. This is because the shelf-side wires 1961 and 1962 may be affected by a physical impact or moisture. The wire cover 1860 protects the shelf-side wires 1961 and 1962 from such physical impact or moisture.

The wire cover 1860 extends from rear to front sides (or front to rear sides) of the bracket 1831, 1832 along the bracket 1831, 1832. Referring to FIG. 10, the wire cover 1860 extends downwardly from the rear side of the left bracket 1831 along the shape of the left bracket 1831, is bent forwardly from the lower side, and then extends into a tilted shape. However, the shape of the wire cover 1860 may not be necessarily limited to this.

The wire cover 1860 is closely adhered to an inner side surface of the left bracket 1831 or the right bracket 1832. The wire cover 1860 covers the shelf-side wires 1961 and 1962. The wire cover 1860 may have a section in a shape like '⊏,' and the shelf-side wires 1961 and 1962 are disposed in a space formed between the wire cover 1860 and the inner side surface of the bracket 1831, 1832. In some implementations, for hermetic sealing, the wire cover 1860 may be provided with a sealing member on a periphery thereof.

Figure 12:
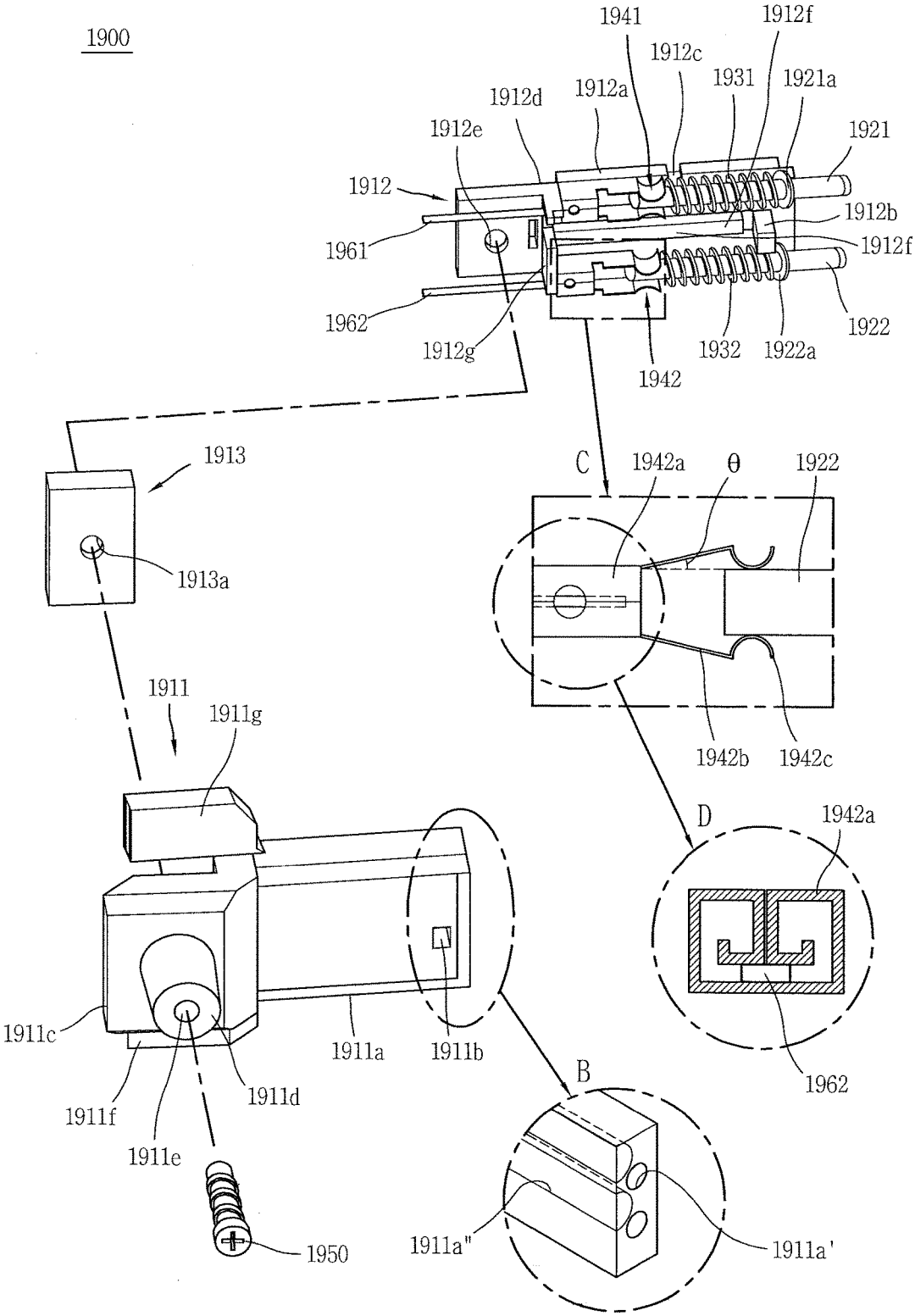
FIG. 12 is a diagram illustrating an example of a disassembled perspective view of the shelf terminal unit illustrated in FIGS. 10 and 11.
Figure 13:
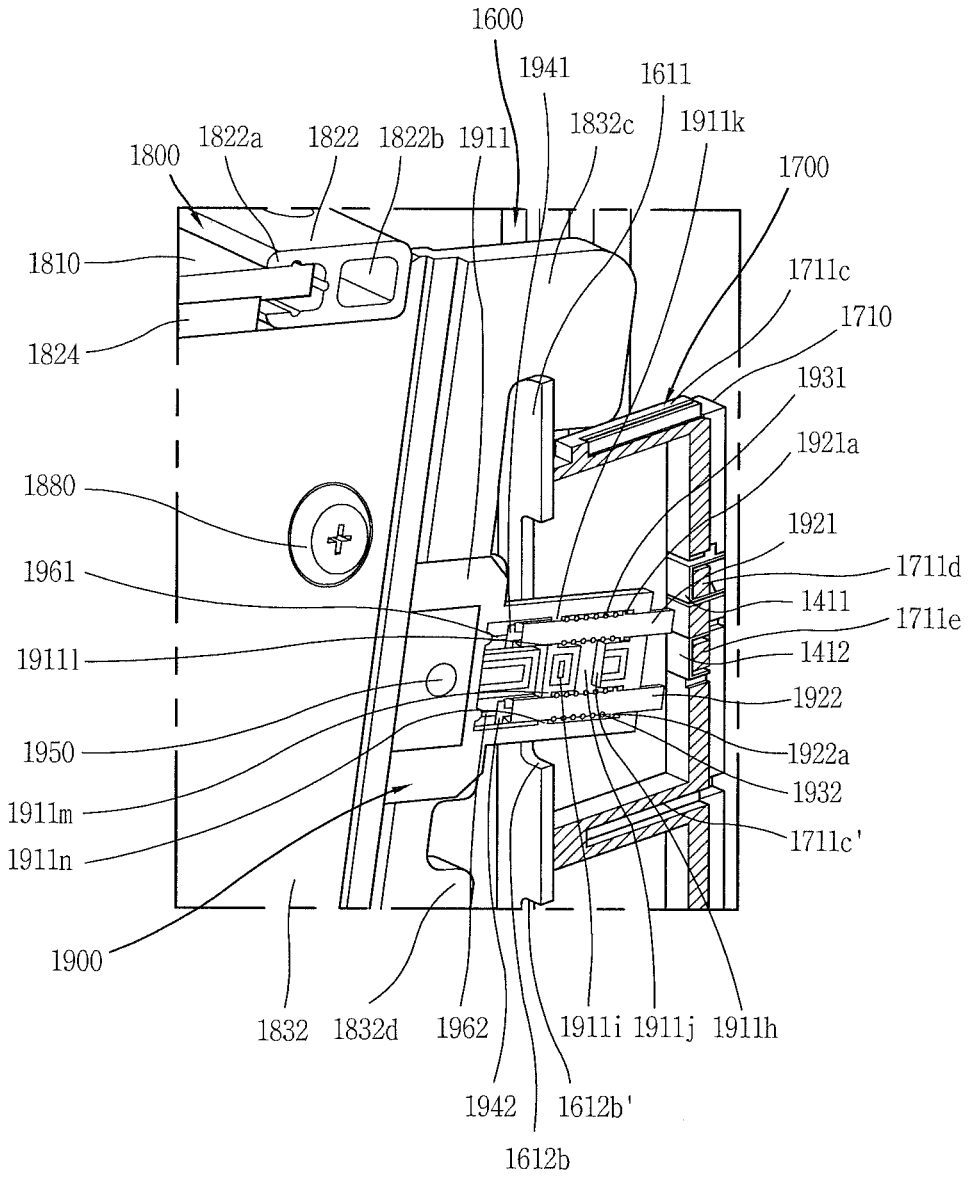
FIGS. 13 and 14 are diagrams illustrating an example of are sectional views illustrating a process of realizing an electric contact between the shelf terminal unit and the holder terminal unit in response to the shelf assembly being mounted to the shelf holder.
Figure 14:
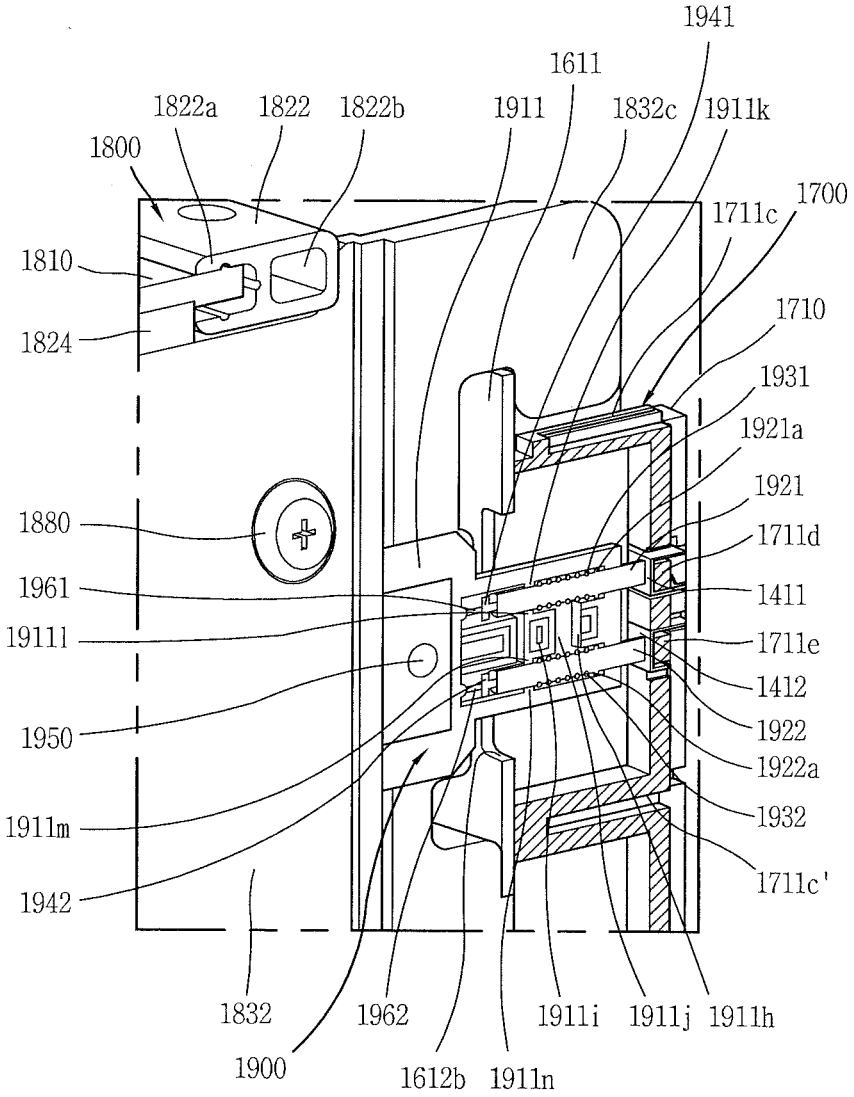

The shelf terminal unit 1900 is coupled to the rear side of the wire cover 1860. The shelf terminal unit 1900 is disposed between the hook portion 8131*c*, 1832*c* and the inserting portion 1831*d*, 1832*d* of the bracket 1831, 1832. Two parts of the shelf terminal unit 1900 are coupled to each other with interposing the wire cover 1860 and the brackets 1831 and 1832 therebetween. This coupling structure is illustrated in FIGS. 12 to 14. The shelf terminal unit 1900 may be installed on the left frame 1831 and/or the right bracket 1832. The wire cover 1860 is coupled to the bracket (at least one of the brackets 1831 and 1832) on which the shelf terminal unit 1900 is installed. FIG. 10 illustrates that the wire cover 1860 is coupled to the left bracket 1831. In some implementations, the wire cover is coupled to the right bracket 1832 based on the coupled state between the shelf terminal unit 1900 and the right bracket 1832. A detailed structure of the shelf terminal unit 1900 will be described later.

The wire cover 1860 is coupled to the bracket 1831, 1832 by a coupling member 1880 (see FIGS. 13 and 14), such as a bolt or the like, at the rear side thereof. The wire cover 1860 and the bracket 1831, 1832 may include coupling holes 1863 and 1831*e*, 1832*e* for insertion of the bolts or the like. The coupling member 1880 such as the bolt or the like may be inserted into the coupling hole 1863 of the wire cover 1860 and the coupling hole 1831*e*, 1832*e* of the brackets 1831 and 1832, such that the wire cover 18670 and the brackets 1831 and 1832 can be coupled to the each other.

The wire cover 1860 includes a first coupling protrusion 1861 and a second coupling protrusion 1962 provided on a front portion thereof.

The first coupling protrusion 1861 protrudes from an outer side of the wire cover 1860 toward the bracket 1831, 1832. The first coupling protrusion 1861 is received in the first receiving groove 1831*a* of the bracket 1831. The first coupling protrusion 1861 is mounted in the first receiving groove 1831*a* of the bracket 1831 at the front of the wire cover 1860, and the rear side of the wire cover 1860 is coupled to the inner side surface of the bracket 1831, 1832 by the coupling member 1880 such as the bolt or the like. This may allow for stable coupling between the wire cover 1860 and the bracket 1831, 1832. Also, the shelf-side wires 1861 and 1862 are disposed between the wire cover 1860 and the bracket 1831, 1832, so as to be protected from the physical impact or moisture.

The second coupling protrusion 1862 protrudes from an inner side of the wire cover 1860 toward the lighting device cover 1850. The second coupling protrusion 1862 may be formed at a substantially opposite side to the first coupling protrusion 1861. The second coupling protrusion 1862 is inserted into another end of the lighting device cover 1850. The second coupling protrusion 1862 may be provided with a sealing member 1865 (see FIG. 11) on an outer circumferential surface thereof. The sealing member 1865 coupled to the outer circumferential surface of the second coupling protrusion 1862 may seal the lighting device cover 1850.

The cap 1870 is partially inserted into one end of the lighting device cover 1850. A more detailed structure of the cap 1870 will be described with reference to FIG. 11.

Figure 11:
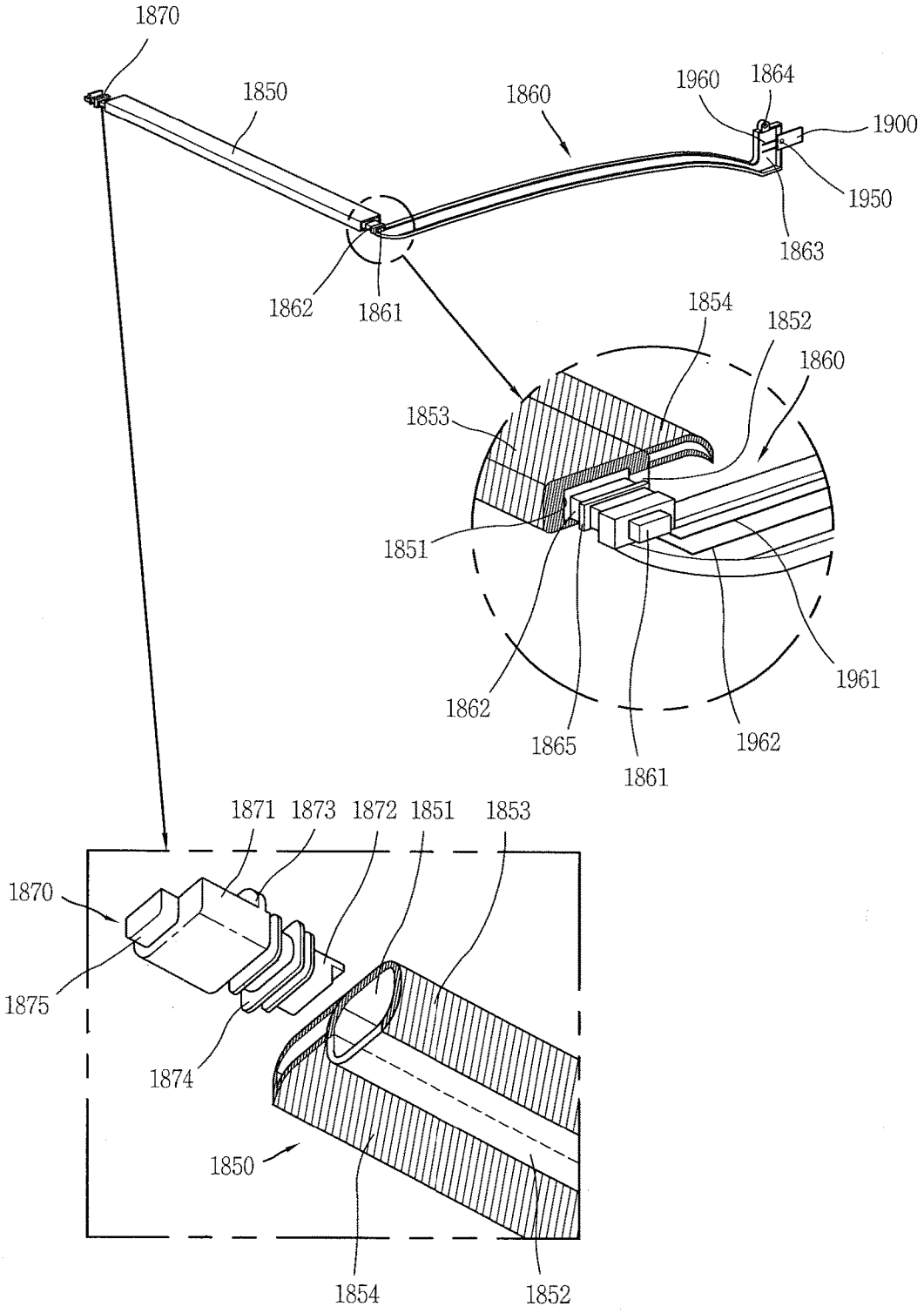
FIG. 11 is a diagram illustrating an example of a perspective view illustrating a lighting device cover, a cap, a wire cover and the shelf terminal unit illustrated in FIG. 10.

FIG. 11 is a diagram illustrating an example of a perspective view of the lighting device cover 1850, the cap 1870, the wire cover 1860 and the shelf terminal unit 1900.

At least part of the lighting device cover 1850 is made of a transparent material 1852, in order for light generated in the lighting device 1840 inserted into the lighting device cover 1850 to light up the inside of the food storage chamber 1200. The lighting device cover 1850 may fully be made of the transparent material 1852, but as aforementioned, it is not preferable that the light is transferred directly to the user.

Therefore, a part of the lighting device cover 1850 may be made of the transparent material 1852, and the other part may be made of an opaque material 1853. By adjusting an area formed of the transparent material 1852, an area of the food storage chamber 1200 to be lighted up may be set. FIG. 11 illustrates the opaque material 1853 (1854 also corresponds to the opaque material) with a slashed line.

The lighting device cover 1850 is provided with an accommodating portion 1851 and a grip portion 1854. The accommodating portion 1851 is an area in which the lighting device cover 1850 is accommodated. The grip portion 1854 may extend from the accommodating portion 1851 toward the rear side and a lower side of the shelf assembly 1800 into a curved shape. The grip portion 1854 may have a shape of double extending from an upper end and a middle portion of the accommodating portion 1851 and connecting ends of the extended portions.

When the shelf assembly 1800 is detached from the shelf holding assembly 1600, the user grips a part of the shelf assembly 1800, and attempts to detach the shelf assembly 1800 from the shelf holding assembly 1600. In this instance, when the user grips the accommodating portion 1851, external force may be applied to the lighting device 1840 within the accommodating portion 1851, and thereby the lighting device 1840 may be damaged.

When the grip portion 1854 extends from the accommodating portion 1851 toward the rear and lower sides of the shelf assembly 1800 into the curved shape, a space where the user situates fingers is naturally generated. The user who detaches the shelf assembly 1800 from the shelf holding assembly 1600 naturally situates the fingers on the grip portion 1854. Accordingly, the external force transferred by the user's fingers is concentrated on the grip portion 1854. And, the external force generated due to the user's fingers can be prevented from being transferred to the lighting device 1840 within the accommodating portion 1851.

The cap 1870 is partially inserted into one end of the lighting device cover 1850. The cap 1870 includes a main body 1871, a first protrusion 1872, a stopping jaw 1873, a sealing member 1874 and a second protrusion 1875.

The main body 1871 is disposed at an outer side of the lighting device cover 1850. Since the installation location of the main body 1871 is nearby the lighting device cover 1850, the main body 1871 may have the same section as the accommodating portion 1851 of the lighting device cover 1850. The first protrusion 1872, the stopping jaw 1873 and the second protrusion 1875 are all formed by protruding from the main body 1871.

The first protrusion 1872 protrudes from the main body 1871 toward the lighting device cover 1850. The first protrusion 1872 is inserted into the lighting device cover 1850.

The sealing member 1874 is coupled to an outer circumferential surface of the first protrusion 1872. The sealing member 1874 seals a gap between the lighting device cover 1850 and the cap 1870, thereby preventing an introduction of moisture into the lighting device cover 1850.

The stopping jaw 1873 protrudes in a perpendicular direction to the protruding direction of the first protrusion 1872. The stopping jaw 1873 is formed to be locked at an inlet of the lighting device cover 1850. The stopping jaw 1873 prevents the cap 1870 from being excessively inserted into the lighting device 1840.

The second protrusion 1875 protrudes from the main body 1871 toward the bracket 1831, 1832. The second protrusion 1875 has a size corresponding to a size of the first receiving groove 1831. The second protrusion 1875 is received in the first receiving groove 1831*a*, 1832*a* of the bracket 1831, 1832. As the cap 1870 and the wire cover 1860 are mounted to the brackets 1831 and 1832 at left and right sides, respectively, the lighting device cover 1850 can be supported by the brackets 1831 and 1832.

Compared with a structure in which the caps 1870 are inserted into both ends of the lighting device cover 1850 and one of the caps 1870 is connected with the wire cover 1860, the structure according to some implementations in which the second coupling protrusion 1862 of the wire cover 1860 is inserted into the another end of the lighting device cover 1850 can more simplify a complicated configuration and also save an unnecessary space which is generated during an assembly of the refrigerator 1000.

The wire cover 1860 includes a first coupling protrusion 1861 and a second coupling protrusion 1862 disposed at the front side thereof.

The first coupling protrusion 1861 protrudes from an outer side of the wire cover 1860 toward the bracket 1831, 1832. The first coupling protrusion 1861 is received in the first receiving groove 1831*a* of the bracket 1831. Since the first coupling protrusion 1861 is received in the first receiving groove 1831*a* of the bracket 1831 at the front of the wire cover 1860 and the rear side of the wire cover 1860 is coupled to the inner side surface of the bracket 1831, 1832 by the coupling member 1880 such as the bolt or the like, thereby enabling stable coupling between the wire cover 1860 and the bracket 1831, 1832. Also, the shelf-side wires 1861 and 1862 are disposed between the wire cover 1860 and the bracket 1831, 1832, and accordingly can be protected from a physical impact or moisture.

The second coupling protrusion 1862 protrudes from an inner side of the wire cover 1860 toward the lighting device cover 1850. The second coupling protrusion 1862 may be formed at a substantially opposite side to the first coupling protrusion 1861. The second coupling protrusion 1862 may be provided with a sealing member 1865 (see FIG. 11) on an outer circumferential surface thereof. The sealing member 1865 coupled to the outer circumferential surface of the second coupling protrusion 1862 can seal the lighting device cover 1850.

The shelf-side wires 1961 and 1962 are protected by the wire cover 1860. The shelf-side wires 1961 and 1962 are inserted into the lighting device cover 1850 through the wire cover 1860. The shelf-side wires 1961 and 1962 are connected to the lighting device 1840 within the lighting device cover 1850. Accordingly, the electric connection between the shelf terminal unit 1900 and the lighting device 1840 can be realized.

FIG. 12 is a diagram illustrating an example of a disassembled perspective view of the shelf terminal unit 1900 illustrated in FIGS. 10 and 11.

The shelf terminal unit 1900 includes housings 1911, 1912 and 1913, pins 1921 and 1922, elastic members 1931 and 1932, contact terminals 1841 and 1942 and shelf-side wires 1961 and 1962.

Hereinafter, for the sake of explanation, a direction that the pins 1921 and 1922 are exposed from the housings 1911, 1912 and 1913 is defined as a rear side of the shelf terminal unit 1900, and a direction that the shelf-side wires 1961 and 1962 are exposed from the housings 1911, 1912 and 1913 is defined as a front side of the shelf terminal unit 1900. The front and rear sides correspond to substantially the same as the front and rear sides of the shelf assembly 1800.

The housings 1911, 1912 and 1913 include a first housing 1911, a second housing 1912, and a third housing 1913. The housings 1911, 1912 and 1913 are coupled to the bracket 1831, 1832 of the shelf assembly 1800.

The housings 1911, 1912 and 1913 accommodate at least part of the pins 1921 and 1922. The second housing 1912 and the third housing 1913 are coupled to the first housing 1911, and the first housing 1911, the second housing 1912 and the third housing 1913 are configured to accommodate the other components of the shelf terminal unit 1900.

The first housing 1911 includes a cover portion 1911*a*, a first wing portion 1911*c*, a coupling member inserting portion 1911*d*, and second wing portions 1911*f* and 1911*g*.

The cover portion 1911*a* covers the second housing 1912. The cover portion 1911*a* also accommodates the pins 1921 and 1922, the elastic members 1931 and 1932, and the contact terminals 1941 and 1942 of the shelf terminal unit 1900. The cover portion 1911*a* extends toward the rear of the shelf terminal unit 1900 along an extending direction of the pins 1921 and 1922. The pins 1921 and 1922, the elastic members 1931 and 1932 and the contact terminals 1941 and 1942 are disposed in a space between the cover portion 1911*a* and the second housing 1912.

Referring to a part B separately showing the cover portion 1911*a*, the cover portion 1911*a* includes two pin holes 1911*a*' corresponding to the pins 1921 and 1922. The two pin holes 1911*a*' are open toward the shelf holding assembly 1600. The pins 1921 and 1922 are configured to be linearly movable in and out of the housing 1911, 1912 and 1913 through the pin holes 1911*a*'.

Unlike the structure illustrated in FIG. 12, a structure in which the first housing 1911 forms a part of the pin holes 1911*a*' and the second housing 1912 forms the rest of the pin holes 1911' may increase a distance between the first housing 1911 and the second housing 1912, and thereby be likely to cause a separation of the pins 1921 and 1922 from the housings 1911, 1912 and 1913. However, the structure according to implementations in which the first housing 1911 has the pin holes 1911*a*' can prevent the separation of the pins 1921 and 1922 even though the distance between the first housing 1911 and the second housing 1912 increases.

The first housing 1911 includes elastic member receiving grooves 1911*a*" in which the elastic members 1931 and 1932 are accommodated. The elastic member receiving grooves 1911*a*" may be formed within the cover portion 1911*a*.

The elastic member receiving grooves 1911*a*" preferably form spaces in a shape of a semicircular pillar corresponding to the elastic members 1931 and 1932. If the elastic member receiving grooves 1911*a*" form a space in a polygonal shape, they are excessively spaced apart from the elastic members 1931 and 1932, which may lower durability.

A radius of curvature of the elastic member receiving groove 1911*a*" is preferably greater than that of the elastic member 1931, 1932. This is because excessive friction is caused between the elastic member 1931, 1932 and the elastic member receiving groove 1911*a*" if the radius of curvature of the elastic member receiving groove 1911*a*" is the same as that of the elastic member 1931, 1932.

The cover portion 1911*a* includes a location setting hole 1911*b* which is open in a direction facing the second housing 1912. The location setting hole 1911*b* may not be limited to the term, and may alternatively be formed in a shape of a recess, groove or the like. The second housing 1912 includes a location setting protrusion 1912*b* corresponding to the location setting hole 1911*b*. The location setting protrusion 1912*b* protrudes from a first base portion 1912*a* of the second housing 1912 in a direction facing the first housing 1911. The locations of the location setting hole 1911*b* and the location setting protrusion 1912*b* may be switched with each other.

The location setting hole 1911*b* and the location setting protrusion 1912*b* set a coupling location between the first housing 1911 and the second housing 1912. When the first housing 1911 and the second housing 1911 are coupled to each other, the location setting protrusion 1912*b* can be inserted into the location setting hole 1912*b*, and thus the first housing 1911 and the second housing 1912 can be coupled at a right position.

The first wing portion 1911*c* protrudes from the cover portion 1911*a* with generating a height difference with the cover portion 1911*a*, and extends to the front of the shelf terminal unit 1900. The second wing portions 1911*f* and 1911*g* protrude from both sides of the cover portion 1911*a*, and extend toward the front of the shelf terminal unit 1900. Unlike the first wing portion 1911*c*, the second wing portions 1911*f* and 1911*g* do not generate the height difference from the cover portion 1911*a*, or generate a height difference smaller than that of the first wing portion 1911*c* even though generating the height difference. Accordingly, the first wing portion 1911*c* and the second wing portions 1911*f* and 1911*g* generate a space therebetween.

In the space formed between the first wing portion 1911*c* and the second wing portions 1911*f* and 1911*g* are disposed the bracket (one of 1831 and 1832) and the wire cover 1860. The first wing portion 1911*c* is closely adhered to the outer side surface of the bracket 1831, 1832 and the second wing portions 1911*f* and 1911*g* may be closely adhered to the wire cover 1860. Alternatively, the second wing portions 1911*f* and 1911*g* may be closely adhered to the outer side surface of the bracket 1831, 1832 and the first wing portion 1911*c* may be closely adhered to the wire cover 1860. If a refrigerator is not provided with the wire cover 1860, the first wing portion 1911*c* may be adhered to one of inner and outer side surfaces of the bracket 1831, 1832 and the second wing portions 1911*f* and 1911*g* may be closely adhered to another of the inner and outer side surfaces of the bracket 1831, 1832.

The first wing portion 1911*c* is provided with a coupling member inserting portion 1911*d*. The coupling member inserting portion 1911*d* may protrude from the first wing portion 1911*c*, but implementations are not necessarily limited to this. The coupling member inserting portion 1911*d* may be made of an elastic material. This may prevent the shelf terminal unit 1900, the bracket 1831, 1832 and the wire cover 1860 from being excessively closely adhered due to a coupling member 1950.

A coupling member inserting hole 1911*e* is formed through the coupling member inserting portion 1911*d*. In a state that the first wing portion 1911*c* and the second wing portions 1911*f* and 1911*g* are closely adhered to the bracket 1831, 1832 and the wire cover 1860, respectively, when the coupling member 1950 such as a bolt or the like is inserted into the coupling member inserting hole 1911*e*, the shelf assembly 1800 and the shelf terminal unit 1900 are coupled to each other. The coupling member 1950 is inserted through all of the coupling member inserting holes 1911*e*, 1912*e* and 1913*a* of the first housing 1911, the second housing 1912 and the third housing 1913.

The second housing 1912 includes a first base portion 1912*a*, a location setting protrusion 1912*b*, drain holes 1912*c*, a second base portion 1912*d*, a coupling member inserting hole 1912*e*, a protruding portion 1912*f* and a base boundary wall 1912*g*.

The first base portion 1912*a* is coupled to the cover portion 1911*a* of the first housing 1911 and thus forms an arrangement space of the pins 1921 and 1922, the elastic members 1931 and 1932 and the contact terminals 1941 and 1942. The first base portion 1912*a* may be formed substantially in a shape of a plate.

The location setting protrusion 1912*b* protrudes from the first base portion 1912*a* in a direction of facing the cover portion 1911*a* of the first housing 1911. It has been described that the location setting protrusion 1912*b* is inserted into the location setting hole 1911*b* of the first housing 1911 to couple the first housing 1911 and the second housing 1912 at a right position.

The drain holes 1912*c* may be formed at both sides of the first base portion 1912*a*, respectively. The drain holes 1912*c* are recessed into both side surfaces of the first base portion 1912*a*. The drain holes 1912*c* of the second housing 1912 are merely formed in a shape of a recess. However, when the first housing 1911 and the second housing 1912 are coupled to each other, the drain holes 1912*c* form a shape of a hole. Therefore, the term of the drain hole 1912*c* is used.

The housings 1911, 1912 and 1913 may absorb moisture easily or be filled with water. Since water is fatal to an electric contact, the water should be discharged out of the housings 1911, 1912 and 1913. The drain holes 1912*c* allow the inside and the outside of the housings 1911, 1912 and 1913 to communicate with each other. The drain holes 1912*c* allow water collected in the housings 1911, 1912 and 1913 to be discharged to outside. FIG. 12 illustrates the drain hole 1912*c* formed on one side of the first base portion 1912*a*, and another drain hole may also be formed on another side of the first base portion 1912*a* In some implementations, the first housing 1911 may also be provided with drain holes corresponding to the drain holes 1912*c* of the second housing 1912. The drain holes of the first housing 1911 may be formed by cutting a part of the cover portion 1911*a*.

The second base portion 1912*d* extends from the first base portion 1912*a* toward the front of the shelf terminal unit 1900. The base boundary wall 1912*g* may be formed between the first base portion 1912*a* and the second base portion 1912*d*. The base boundary wall 1912*g* protrudes from a boundary between the first base portion 1912*a* and the second base portion 1912*d* to prevent a separation of the shelf-side wires 1961 and 1962.

The second base portion 1912*d* faces the first wing portion 1911*c* of the first housing 1911 and the third housing 1913. The second base portion 1912*d* is provided with the coupling member inserting hole 1912*e*. The coupling member inserting holes 1911*e*, 1912*e* and 1913*a* of the first housing 1911, the second housing 1912 and the third housing 1913 are formed at positions corresponding to one another.

The protruding portion 1912*f* protrudes from the first base portion 1912*a*. The protruding portion 1912*f* forms a boundary between the first pin 1921 and the second pin 1922, and prevents the separation of the two pins 1921 and 1922.

The pins 1921 and 1922 may be formed in a circular pillar or a polygonal pillar. The pins 1921 and 1922 are exposed to the outside of the shelf terminal unit 1900 to be brought into contact with the holder-side terminals 1741 and 1742 (see FIGS. 5 to 8 and 13 to 14). The outside of the shelf terminal unit 1900 indicates the outside of the housings 1911, 1912 and 1913. Therefore, the pins 1921 and 1922 are partially exposed to the outside of the housings 1911, 1912 and 1913. As the pins 1921 and 1922 are brought into contact with the holder-side terminals 1741 and 1742, an electrical connection between the shelf terminal unit 1900 and the holder terminal unit 1700 is achieved.

The pins 1921 and 1922 may be made of stainless steel. In some implementations, this may prevent formation of rust. Alternatively, if the pins 1921 and 1922 are physically connected to the shelf-side wires 1961 and 1962 in a soldering manner, brass may be used and a method of plating nickel on the brass to prevent corrosion may be considered. However, if the plated nickel rubs off, the brass may be corroded. According to some implementations, the pins 1921 and 1922 are made of stainless steel and the shelf-side wires 1961 and 1962 and the pins 1921 and 1922 are physically and electrically connected by the contact terminals 1941 and 1942 to be explained later. This may mitigate the problem of generating rust.

The pins 1921 and 1922 are elastically movable linearly toward inner and outer sides of the shelf terminal unit 1900. The elastic linear movement of the pins 1921 and 1922 is implemented by the elastic members 1931 and 1932, pin-side ribs 1921*a* and 1922*a* and housing-side ribs 1911*k*, 1911*l*, 1911*m* and 1911*n* (see FIGS. 13 and 14). The elastic members 1931 and 1932 are disposed between the pin-side ribs 1921*a* and 1922*a* and the housing-side ribs 1911*k*, 1911*l*, 1911*m* and 1911*n*.

The elastic members 1931 and 1932 are disposed within the housings 1911, 1912 and 1913. Each elastic member 1931, 1932 provides a restoring force to each pin 1921, 1922 to implement the elastic linear movement of the pin 1921, 1922. The elastic member 1931, 1932 may be implemented as a spring surrounding the outer circumferential surface of the pin 1921, 1922. When external force is applied to the pin 1921, 1922, the elastic member 1931, 1932 is compressed. On the other hand, when the external force is not applied to the pin 1921, 1922, the elastic member 1931, 1932 is restored.

The pin-side ribs 1921*a* and 1922*a* protrude from the outer circumferential surfaces of the pins 1921 and 1922, and are integrally formed with the pins 1921 and 1922. The pin-side rib 1921*a*, 1922*a* has a radius great than that of the pin hole 1911*a*' to be locked in the pin hole 1911*a*'. Accordingly, the pin-side ribs 1921*a* and 1922*a* can prevent the pins 1921 and 1922 from being separated from the housings 1911, 1912 and 1913.

Also, each of the pin-side ribs 1921*a* and 1922*a* is formed to face one end of each of the elastic members 1931 and 1932, and has a greater radius than each of the elastic members 1931 and 1932. Therefore, the restoring force applied from one end of each of the elastic members 1931 and 1932 is transferred to each of the pin-side ribs 1921*a* and 1922*a*. The pin-side ribs 1921*a* and 1922*a* are pressed to be close to the pin holes 1911*a*' by the restoring force of the elastic members 1931 and 1932.

Examples of housing-side ribs 1911*k*, 1911*l*, 1911*m* and 1911*n* are illustrated in FIGS. 13 and 14. Referring to FIGS. 13 and 14, the housing-side ribs 1911*k*, 1911*l*, 1911*m* and 1911*n* protrude from an inner side of the first housing 1911 to be integrally formed with the first housing 1911. However, implementations may also be applied to scenarios in which the housing-side ribs 1911*k*, 1911*l*, 1911*m* and 1911*n* protrude from an inner side of the second housing 1912 to be integrally formed with the second housing 1912.

The housing-side ribs 1911*k*, 1911*l*, 1911*m* and 1911*n* are formed to face another ends of the elastic members 1931 and 1932, and each has a radius greater than that of each of the elastic members 1931 and 1932. Therefore, the restoring forces applied from the another ends of the elastic members 1931 and 1932 are transferred to the housing-side ribs 1911*k*, 1911*l*, 1911*m* and 1911*n*. Since the housing-side ribs 1911*k*, 1911*l*, 1911*m* and 1911*n* are fixed, repulsive force (reaction) against the restoring force (action) is transferred to the elastic members 1931 and 1932 and the elastic member 1931 and 1932 are closely adhered to the pin-side ribs 1921 and 1922.

Since the housing-side ribs 1911*k*, 1911*l*, 1911*m* and 1911*n* are closely adhered to the pin-side ribs 1921*a* and 1922*a*, the pins 1921 and 1922 which are integrally formed with the pin-side ribs 1921*a* and 1922*a* receive force trying to move to outside of the housings 1911, 1912 and 1913. However, since the pin-side ribs 1921*a* and 1922*a* are stopped on peripheries of the pin-side ribs 1921*a* and 1922*a*, the movement of the housings 1911, 1912 and 1913 is limited by the pin-side ribs 1921*a* and 1922*a*. Therefore, when external force for forcibly moving the pins 1921 and 1922 to the inside is applied and then removed, the pins 1921 and 1922 which have linearly moved to the inside are moved again up to locations where the pin-side ribs 1921*a* and 1922*a* are closely adhered to the pin holes 1911*a*'.

It has been aforementioned that the holder-side terminals 1741 and 1742 (see FIGS. 5 to 8 and 13 to 14) of the holder terminal unit 1700 are fixed to the body 1710 (see FIGS. 3 to 7). Therefore, when the pins 1921 and 1922 are brought into contact with the holder-side terminals 1741 and 1742, the pins 1921 and 1922 receive force trying to move into the housings 1911, 1912 and 1913, and then move into the housings 1911, 1912 and 1913.

As the pins 1921 and 1922 move into the housings 1911, 1912 and 1913, the restoring force is stored in the compressed elastic members 1931 and 1932. The restoring force may allow the pins 1921 and 1922 to be closely adhered to the holder-side terminals 1741 and 1742. Accordingly, the pins 1921 and 1922 and the holder-side terminals 1741 and 1742 can maintain an electric contact state with stability and high reliability.

Also, even though the shelf terminal unit 1900 is repetitively detached or attached, impacts applied to the pins 1921 and 1922 can be reduced by the elastic members 1931 and 1932, thereby ensuring durability of the shelf terminal unit 1900.

The pins 1921 and 1922 include a first pin 1921 and a second pin 1922 for connection of a positive (+) pole and a negative (−) pole. The first pin 1921 is connected to the first shelf-side wire 1961 through the first contact terminal 1941. The second pin 1922 is connected to the second shelf-side wire 1962 through the second contact terminal 1942. One end of each of both ends of the two pins 1921 and 1922 is exposed to outside of the housings 1911, 1912 and 1913, and another end thereof is brought into contact with the corresponding contact terminal 1941, 1942.

The contact terminals 1941 and 1942 are disposed at the front of the pins 1921 and 1922. The contact terminals 1941 and 1942 have a structure of maintaining the contact state with the pins 1921 and 1922. The contact terminals 1921 and 1922 are coupled to the shelf-side wires 1961 and 1962. The contact terminals 1941 and 1942 allow for an electric connection between the shelf-side wires 1961 and 1961 and the pins 1921 and 1922.

The shelf-side wires 1961 and 1962 are electrically connected to the lighting unit 1840. In the refrigerator 1000 according to some implementations, the lighting device 1840 and a power supply unit are electrically connected through a sequential connection of the shelf-side wires 1961 and 1962, the contact terminals 1941 and 1942, the pins 1921 and 1922, the holder-side terminals 1741 and 1742, and the holder-side wires 1731 and 1732.

The contact terminals 1941 and 1942 press the outer circumferential surfaces of the pins 1921 and 1922 from both sides to maintain the contact state with the pins 1921 and 1922. Since the contact terminals 1941 and 1942 press the outer circumferential surfaces of the pins 1921 and 1922 at the both sides, the contact state between the pins 1921 and 1922 and the contact terminals 1941 and 1942 can be maintained even though the pins 1921 and 1922 move to inside and outside of the housings 1911, 1912 and 1913.

Each of the contact terminals 1941 and 1942 may be divided into a first portion 1942*a*, a second portion 1942*b* and a third portion 1942*c*. The first portion 1942*a*, the second portion 1942*b* and the third portion 1942*c* will be described with reference to an enlarged view C and a sectional view D of the contact terminals 1941 and 1942 in FIG. 12.

The first portion 1942*a* is electrically brought into contact with the shelf-side wire 1961, 1962. Referring to the sectional view D showing the connection between the first portion 1942*a* and the shelf-side wire (e.g., 1962), one of two branches of the first portion 1942*a* is bent several times from a left side in a counterclockwise direction, and the other branch is bent several times from a right side in a clockwise direction, so as to be brought into contact with the shelf-side wire (e.g., 1962). The first portion 1942*a* presses both sides of the shelf-side wire 1962 to be physically and electrically connected to the-shelf-side wire 1962.

The second portion 1942*b* extends from the first portion 1942*a* into two branches with forming a preset angle Θ in the linearly-moving direction of the pin (e.g., 1922). When the extending direction of the second portion 1942*b* is in parallel to the linearly-moving direction of the pin 1922, the third portion 1942*c* may excessively be pressed and the second portion 1942*b* may easily be damaged. According to some implementations, as the second portion 1942*b* forms the preset angle with the linearly-moving direction of the pin 1922, the excessive pressing can be prevented, and thus reliability of the contact terminal 1941, 1942 can be ensured.

The third portion 1942*c* extends from the second portion 1942*b* into a semicircular shape and is brought into contact with an outer circumferential surface of the pin 1922. The third portion 1942*c* presses the outer circumferential surface of the pin 1922. Also, two branches of the third portion 1942*c* are pressed by the pin 1922 in a direction of getting away from each other. Therefore, the third portion 1942*c* elastically presses the pin 1922.

The third housing 1913 is disposed to face the first wing portion 1911*c* of the first housing 1911, and coupled to the first housing 1911. The shelf-side wires 1961 and 1962 may be disposed between the second housing 1912 and the third housing 1913 or between the first housing 1911 and the third housing 1913. When the shelf-side wires 1961 and 1962 are disposed between the first housing 1911 and the third housing 1913, the shelf-side wires 1961 and 1962 may additionally be protected by the first housing 1911 and the third housing 1913. This is because the second housing 1912 and the third housing 1913 are spaced apart from each other but the first housing 1911 and the third housing 1913 are coupled to each other.

The foregoing description has been given sequentially of the shelf holding assembly 1600 (see FIGS. 1 to 3 and 6 to 7), the holder terminal unit 1700, the shelf assembly 1800 (see FIGS. 1 and 9 to 10) and the shelf terminal unit 1900. Hereinafter, description will be given of a process of electrically connecting the shelf terminal unit 1900 and the holder terminal unit 1700 by attaching the shelf assembly 1800 to the shelf holding assembly 1600.

FIGS. 13 and 14 are sectional views illustrating the process of electrically connecting the shelf terminal unit 1900 and the holder terminal unit 1700 by attaching the shelf assembly 1800 to the shelf holding assembly 1600. FIGS. 13 and 14 omit a cover for preventing the drawings from being excessively complicated.

The rear frame 1822 is coupled to the rear of the shelf 1810. One portion 1822*a* of the rear frame 1822 has a section in a shape like '⊏'and surrounds a rear edge of the shelf 1810. Also, another portion 1822*b* of the rear frame 1822 has a section in a shape like '□' and protects the rear edge of the shelf 1810 from impact.

The right frame 1824 is coupled to a right edge of the shelf 1810. The right frame 1824 partially surrounds a right edge of the shelf 1810. The right frame 1824 is supported by the right bracket 1832.

The coupling member 1880 such as the bolt or the like is coupled to the outer side surface of the right bracket 1832. The coupling member may allow the wire cover 1860 (see FIGS. 10 and 11) to be coupled to the inner side surface of the right bracket 1832.

The hook portion 1832*c* and the inserting portion 1832*d* are formed on the rear of the right bracket 1832. The hook portion 1832*c* and the inserting portion 1832*d* are components required for attaching the shelf assembly 1800 to the shelf holding assembly 1600. The hook portion 1832*c* is disposed more above the inserting portion 1832*d*, while the inserting portion 1832*d* is more below the hook portion 1832*c*.

The hook portion 1832*c* is formed to be insertable into the hole 1612*a* of the shelf holding assembly 1600. Also, the hook portion 1832*c* is formed to be mounted on the shelf supporting portion 1611 of the shelf holding assembly 1600. The hook portion 1832*c* protrudes from the rear side of the right bracket 1832 toward the hole 1612*a* of the shelf holding assembly 1600, and extends downwardly to be mounted on the shelf supporting portion 1611 of the shelf holding assembly 1600.

The inserting portion 1832*d* protrudes from the rear side of the right bracket 1832 toward the hole 1612*b*' of the shelf holding assembly 1600. One part of the inserting portion 1832*d* is inserted into the hole 1612*b*' of the shelf holding assembly 1600, and another part thereof is supported by the shelf supporting portion 1611.

In order to attach the shelf assembly 1800 to the shelf holding assembly 1600, at least three holes 1612*a*, 1612*b* and 1612*b*' which are arranged in an up and down directions are required. The hook portion 1832*c* is inserted into the uppermost hole 1612*a* of the three holes, the shelf terminal unit 1900 is inserted into the middle hole 1612*b*, and the inserting portion 1832*d* is inserted into the lowermost hole 1612*b*'.

Referring to the section of the shelf terminal unit 1900, the two pins 1821 and 1922 are disposed within the first housing 1911. The two pins 1921 and 1922 may be classified into the first pin 1921 and the second pin 1922. The first pin 1921 and the second pin 1922 are spaced apart from each other and extend in parallel to each other.

The elastic members 1931 and 1932 are coupled to the outer circumferential surfaces of the pins 1921 and 1922. The pins 1921 and 1922 are provided with the pin-side ribs 1921*a* and 1922*a* respectively protruding from locations facing one end of each of the elastic members 1931 and 1932. The first housing 1911 includes the housing-side ribs 1911*k*, 1911*l*, 1911*m* and 1911*n* protruding from locations facing another end of each of the elastic members 1931 and 1932.

The elastic members 1931 and 1932 are disposed between the pin-side ribs 1921*a* and 1922*a* and the housing-side ribs 1911*k*, 1911*l*, 1911*m* and 1911*n*. The elastic members 1931 and 1932 are maintained in a compressed state by the pin-side rib 1921*a* and 1922*a* and the housing-side ribs 1911*k*, 1911*l*, 1911*m* and 1911*n*, and transfer the restoring force to the pin-side ribs 1921*a* and 1922*a* and the housing-side ribs 1911*k*, 1911*l*, 1911*m* and 1911*n*. The elastic members 1931 and 1932 allow the elastic linear movement of the pins 1921 and 1922.

The contact terminals 1941 and 1942 are disposed at the rear of the pins 1921 and 1922. The contact terminals 1941 and 1942 implement the electric connection between the shelf-side wires 1961 and 1962 and the pins 1921 and 1922.

The first housing 1911 is provided with a plurality of protruding portions 1911*h* formed between the first pin 1921 and the second pin 1922. The plurality of protruding portions 1911*h* protrude from the inside of the first housing 1911 toward the second housing 1912. The plurality of protruding portions 1911*h* form a boundary between the first pin 1921 and the second pin 1922. FIGS. 13 and 14 illustrate three of the protruding portions 1911*h*.

A ultrasonic coupling portion 1911*i* is formed on a surface of each protruding portion 1911*h*. The coupling between the first housing 1911 and the second housing 1912 (see FIG. 12) is implemented by attaching the protruding portions 1911*h* to the second housing 1912 in a manner of applying ultrasonic waves to the surfaces of the protruding portions 1911*h*. The front side of the first housing 1911 is attached to the second housing 1912 by the ultrasonic coupling portion 1911i, and the rear side of the first housing 1911 is coupled to the second housing 1912 by the coupling member 1950.

The plurality of protruding portions 1911*h* are spaced apart from one another with drain channels 1911*j* interposed therebetween. Since the plurality of protruding portions 1911*h* are arranged in a horizontal direction, the drain channels 1911*j* are formed in a vertical direction. FIGS. 13 and 14 illustrate two of the drain channels 1911*j* among the three protruding portions 1911*h*. The water collected in the housings 1911, 1912 and 1913 may be discharged out thereof through the drain channels 1911*j* and the aforementioned drain holes 1912*c* (see FIG. 12).

The aforementioned structure may also be applied to the left side of the shelf assembly 1800.

The holder-side terminals 1741 and 1742 are exposed within the body 1710. The holder-side terminals 1741 and 1742 include the first holder-side terminal 1941 and the second holder-side terminal 1742 corresponding to the first pin 1921 and the second pin 1922. A height difference between the first holder-side terminal 1741 and the second holder terminal 1742 is the same as a spaced distance between the pin 1921 and the second pin 1922. Since the first holder-side terminal 1741 and the second holder-side terminal 1742 are spaced apart from each other, an electric insulation therebetween is maintained. Also, since the first pin 1921 and the second pin 1922 are spaced apart from each other, an electric insulation therebetween is maintained.

The body 1710 may be provided in plurality. The plurality of bodies 1710 may be stacked one another. The bodies 1710 can be coupled by the protruded coupling portion 1711*c* and the recessed coupling portion 1711*c*'. A height of the body 1710 may preferably correspond to a spaced distance among the holes 1612*a*, 1612*b* and 1612*b*'. Accordingly, when the plurality of bodies 1710 are stacked at the rear of the shelf holding assembly 1600, although the height of the shelf assembly 1800 changes, the electric connection between the shelf terminal unit 1900 and the holder terminal unit 1700 can be implemented.

The attachment of the shelf assembly 1800 may be implemented by a first operation and a second operation which will be explained below. The first operation corresponds to an operation of inserting the hook portion 1832*c* of the shelf assembly 1800 into the hole of the shelf holding assembly 1600 to be locked on the shelf supporting portion 1611. The second operation corresponds to an operation of inserting one part of the inserting portion 1832*d* into the hole of the shelf holding assembly 1600 and closely adhering another part of the inserting portion 1832*d* to the shelf holding assembly 1600. The first operation and the second operation are continuously carried out or simultaneously carried out. By the first and second operations, the shelf assembly 1800 is inserted into the body 1710 through the hole 1612*b* of the shelf holding assembly 1600 between the hook portion 1832*c* and the inserting portion 1832*d*.

FIG. 13 is a diagram illustrating an example of a result of the first operation. FIG. 14 is a diagram illustrating an example of a result of the second operation. According to the result of the second operation, the shelf terminal unit 1900 is inserted into the body 1710 through the hole 1612*b* of the shelf holding assembly 1600 between the hook portion 1832*c* and the inserting portion 1832*d*.

The pins 1921 and 1922 are brought into contact with the holder-side terminals 1741 and 1742 and receive external force transferred from the holder-side terminals 1741 and 1742. The pins 1921 and 1922 are pressed into the shelf terminal unit 1900 by the holder-side terminals 1741 and 1742. The pins 1921 and 1922 move into the shelf terminal unit 1900 with maintaining the contact with the holder-side terminals 1741 and 1742.

The elastic members 1931 and 1932 supply restoring force to the pins 1921 and 1922 by being locked in the pin-side ribs 1921*a* and 1922*a*, and the pins 1921 and 1922 receive the restoring force toward the outside of the shelf terminal unit 1900. Accordingly, the pins 1921 and 1922 can be maintained in the contact state with the holder-side terminals 1741 and 1742.

The configurations and methods of the refrigerator in the aforesaid description are not limited thereto, and implementations may be configured by a selective combination of all or part of the description so as to implement many variations.

What is claimed is:

1. A refrigerator comprising:

a food storage chamber comprising at least one wall;

a shelf holder installed on a wall of the food storage chamber, the shelf holder having a plurality of holes spaced apart from one another along a vertical direction;

a shelf assembly attachable to the shelf holder via at least one of the plurality of holes;

an electronic device provided on the shelf assembly;

a holder terminal unit provided between the shelf holder and the wall, the holder terminal unit having at least one holder-side terminal disposed to face at least one of the plurality of holes; and a shelf terminal unit provided at a side of the shelf assembly that is configured to attach to the shelf holder, the shelf terminal unit comprising:

at least one pin provided on the shelf terminal unit and configured to electrically connect to the at least one holder-side terminal in a state in which the shelf assembly is attached to the shelf holder, the at least one pin being electrically connected to the electronic device provided on the shelf assembly, and at least one elastic component coupled to the at least one pin and configured to, in a state in which the shelf assembly is attached to the shelf holder, exert a restoring force on the at least one pin in a direction towards the at least one holder-side terminal of the holder terminal unit.

2. The refrigerator of claim 1, wherein the shelf assembly comprises:

a shelf portion; and at least one bracket provided beneath the shelf portion and configured to support the shelf portion.

3. The refrigerator of claim 2, wherein the shelf assembly is configured to attach to shelf holder by a bracket of the at least one bracket of the shelf assembly attaching to a hole among the plurality of holes of the shelf holder.

4. The refrigerator of claim 3, wherein:

the holder terminal unit is positioned behind the hole of the shelf assembly and connects to the at least one pin of the shelf terminal unit through the hole.

5. The refrigerator of claim 3, wherein the shelf holder further comprises a plurality of covers, each cover configured to cover one hole of the plurality of holes in a state in which the at least one bracket of the shelf assembly is not attached to the one hole of the plurality of holes.

6. The refrigerator of claim 2, wherein the electronic device is attached to the at least one bracket at a position below the shelf portion of the shelf assembly.

7. The refrigerator of claim 1, wherein:

the shelf holder is provided on a rear wall of the food storage chamber, the holder terminal unit is provided at a rear side of the shelf holder, the shelf terminal unit is provided at a rear side of the shelf assembly, and the elastic component is configured to exert the restoring force on the at least one pin in a rearward direction.

8. The refrigerator of claim 1, wherein the shelf terminal unit comprises at least one contact terminal that is configured to:

electrically connect to the electronic device by at least one shelf-side wire, and exert a force on the at least one pin that maintains a contact state with the at least one pin.

9. The refrigerator of claim 8, wherein each of the at least one contact terminal comprises:

a first portion connected to the at least one shelf-side wire;

a second portion extending from the first portion forming a first angle with a longitudinal axis of the pin; and a third portion extending from the second portion and forming a semicircular shape configured to exert the force on the at least one pin on an outer circumferential surface of the at least one pin.

10. The refrigerator of claim 9, wherein the shelf terminal unit comprises:

a shelf terminal unit housing coupled to a rear side of the shelf assembly and accommodating at least part of the at least one pin;

wherein the at least one elastic component is disposed within the shelf terminal unit housing and surrounds the outer circumferential surface of the at least one pin.

11. The refrigerator of claim 10, wherein:

the at least one pin comprises pin-side ribs protruding from the outer circumferential surface of the at least one pin and configured to prevent a separation of the at least one pin from the shelf terminal unit housing, each of the pin-side ribs formed at a location facing a first end of the at least one elastic component, the shelf terminal unit housing comprises housing-side ribs protruding from inside of the shelf terminal unit housing and configured to limit a movement of the at least one elastic component, each of the housing-side ribs formed at a location facing a second end of the at least one elastic component that is opposite to the first end, and the at least one elastic component is compressed by the pin-side ribs and the housing-side ribs, and supply the restoring force to the pin-side ribs and the housing-side ribs.

12. The refrigerator of claim 10, wherein:

the at least one pin comprises a first pin and a second pin that are spaced apart from each other, the shelf terminal unit housing comprises a plurality of protruding portions formed between the first pin and the second pin, and the plurality of protruding portions are spaced apart from one another by interposing drain channels therebetween.

13. The refrigerator of claim 10, wherein the shelf terminal unit housing is provided with at least one drain hole that forms an opening between an inside of the shelf terminal unit and an outside of the shelf terminal unit.

14. The refrigerator of claim 10, wherein:

the shelf terminal unit housing comprises at least one elastic component receiving groove in which the at least one elastic component is received, and a radius of curvature of each of the at least one elastic component receiving groove is greater than a radius of curvature of each of the at least one elastic component.

15. The refrigerator of claim 10, wherein:

the shelf terminal unit housing comprises at least one pin hole that is formed in a direction toward the shelf holder in a state in which the shelf assembly is attached to the shelf holder, and the at least one pin is linearly movable relative to the shelf terminal unit housing through the at least one pin hole.

16. The refrigerator of claim 1, wherein the holder terminal unit comprises:

an opening that is opened toward the food storage chamber, and a holder terminal unit body that is installed on a rear side -of the shelf holder in a direction that faces the holes, wherein the at least one holder-side terminal is fixed to the holder terminal unit body.

17. The refrigerator of claim 16, wherein:

the holder terminal unit comprises at least one holder-side wire disposed on a rear side of the holder terminal unit body, and at least some parts of the at least one holder-side terminal are exposed to an inside of the holder terminal unit body and other parts of the at least one holder-side terminal are connected to the at least one holder-side wire through the holder terminal unit body.

18. The refrigerator of claim 16, wherein each of the at least one holder-side terminal comprises a stopping portion that is bent from an outside of the holder terminal unit body and locked on a rear surface of the holder terminal unit body.

19. The refrigerator of claim 16, wherein:

each of the at least one holder-side terminal comprises a recess portion having a periphery that is smaller than a periphery of a coating member of each holder-side wire, and the recess portion is insertable into the coating member of the holder-side wire such that the periphery of the recess portion is contactable with a conductive member within the coating member.

20. The refrigerator of claim 16, wherein the holder terminal unit body is provided with at least one drain hole that provides an opening between an inside of the holder terminal unit and an outside of the holder terminal unit.

21. The refrigerator of claim 20, wherein the at least one drain hole is provided at a location on the holder terminal unit that is vertically below a location of the at least one holder-side terminal.

22. The refrigerator of claim 16, wherein each of the at least one holder-side terminal is spaced apart from a bottom surface of the holder terminal unit body.

23. The refrigerator of claim 16, further comprising a cover disposed between the shelf holder and the holder terminal unit body, wherein the cover comprises a cut portion through which the shelf terminal unit is inserted.

24. The refrigerator of claim 23, wherein the cover is provided with a door in a cantilevered shape that is configured to be pushed by the shelf terminal unit.

25. The refrigerator of claim 2, wherein the electronic device comprises a lighting device.

26. The refrigerator of claim 25, wherein:

the lighting device is configured to emit light by receiving power in a state in which the at least one shelf-side terminal and the at least one holder-side terminal are brought into contact with each other and electrically connected, and the shelf assembly further comprises:

a wire cover extending from a rear side to a front side of one of the at least one bracket along the at least one bracket, the wire cover being coupled to an inner side surface of the one of the at least one bracket and covers at least one shelf-side wire connecting the lighting device to the at least one shelf-side terminal.

27. The refrigerator of claim 26, wherein:

the at least one bracket comprises a left bracket supporting a left side of the shelf portion, and a right bracket supporting a right side of the shelf portion, the shelf assembly comprises:

a lighting device cover formed to accommodate the lighting device and having both ends open, at least part of the lighting device composed of a transparent material; and a cap that is partially inserted into a first end of the lighting device cover and mounted on one of the left bracket and one end of the right bracket, wherein the wire cover is inserted into a second end of the lighting device cover and mounted on another of the left bracket and the right bracket.

28. The refrigerator of claim 27, wherein the at least one shelf-side wire is inserted into the lighting device cover through the wire cover, and is connected to the lighting device disposed within the lighting device cover.

29. The refrigerator of claim 25, wherein the lighting device is configured to illuminate an area below or to the rear of the lighting device.

30. The refrigerator of claim 1, wherein the shelf portion is configured to slide in a forward direction relative to the at least one bracket.

31. The refrigerator of claim 30, wherein the shelf portion is configured to slide in the forward direction such that a front of the shelf portion is positioned further forward than the electronic device.

32. A refrigerator comprising:

a food storage chamber comprising at least one wall;

a shelf holder having a plurality of holes spaced apart from one another along a vertical direction and installed on a wall of the food storage chamber;

a shelf assembly attachable to the shelf holder via at least one of the plurality of holes;

an electronic device provided on the shelf assembly;

a holder terminal unit provided between the shelf holder and the wall, the holder terminal unit having at least one holder-side terminal disposed to face at least one of the plurality of holes, and a shelf terminal unit provided at a side of the shelf assembly that is configured to attach to the shelf holder, the shelf terminal unit having at least one pin configured to electrically connect to the at least one holder-side terminal in a state in which the shelf assembly is attached to the shelf holder, the at least one pin being electrically connected to the electronic device provided on the shelf assembly, wherein the at least one pin is longitudinally movable relative to the shelf terminal unit.

* * * * *